US010081192B2

(12) United States Patent
Kobayashi et al.

(10) Patent No.: US 10,081,192 B2
(45) Date of Patent: Sep. 25, 2018

(54) LIQUID CARTRIDGE

(71) Applicant: BROTHER KOGYO KABUSHIKI KAISHA, Nagoya-shi, Aichi-ken (JP)

(72) Inventors: Tetsuro Kobayashi, Nagoya (JP); Suguru Tomoguchi, Okazaki (JP); Akihito Ono, Nagoya (JP); Kosuke Nukui, Nagoya (JP); Hiroaki Takahashi, Nagoya (JP); Naoya Okazaki, Gifu-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/278,878

(22) Filed: Sep. 28, 2016

(65) Prior Publication Data

US 2017/0282569 A1 Oct. 5, 2017

(30) Foreign Application Priority Data

Mar. 31, 2016 (JP) ..... 2016-072384

(51) Int. Cl.
*B41J 2/175* (2006.01)

(52) U.S. Cl.
CPC ..... *B41J 2/17513* (2013.01)

(58) Field of Classification Search
CPC ..... B41J 2/17513; B41J 2/175
See application file for complete search history.

(56) References Cited

U.S. PATENT DOCUMENTS 5,997,121 A * 12/1999 Altfather ..... B41J 2/17513 250/577
7,284,846 B2 10/2007 Katayama
7,445,322 B2 * 11/2008 Kitabatake ..... B41J 2/17553 347/86
2003/0128256 A1 * 7/2003 Oda ..... B41J 2/17503 347/85
2007/0236548 A1 * 10/2007 Ohira ..... B41J 2/17509 347/86

(Continued)

FOREIGN PATENT DOCUMENTS

EP 2607082 A1 6/2013
EP 2 982 515 A1 10/2016
JP 2012-96449 A 5/2012

OTHER PUBLICATIONS

Related U.S. Appl. No. 14/838,597, as filed.

(Continued)

*Primary Examiner* — Patrick King
(74) *Attorney, Agent, or Firm* — Merchant & Gould P.C.

(57) ABSTRACT

A liquid cartridge includes a liquid supply port configured to provide communication between an interior and an exterior of the liquid cartridge, a first wall having the liquid supply port, and a second wall spaced from the first wall. A first storage chamber is between the first and second walls, and a second storage chamber is between the first and second walls communicating with both the liquid supply port and the first storage chamber. A prism is in the second storage chamber, and the prism has an inclined surface configured to change the state of received light in response to a level of liquid contained in the second storage chamber. The prism is positioned between the first and second walls and above the first storage chamber.

30 Claims, 13 Drawing Sheets

(56) References Cited

U.S. PATENT DOCUMENTS

| | | | | |
|---|---|---|---|---|
| 2007/0285484 | A1* | 12/2007 | Sasaki | B41J 2/17513 347/86 |
| 2012/0182365 | A1 | 7/2012 | Ma | |
| 2013/0278684 | A1* | 10/2013 | Kanbe | B41J 2/17526 347/86 |
| 2016/0039213 | A1* | 2/2016 | Tomoguchi | B41J 2/17503 347/86 |
| 2016/0200114 | A1* | 7/2016 | Nanjo | B41J 2/17526 347/86 |
| 2016/0279959 | A1 | 9/2016 | Okazaki | |

OTHER PUBLICATIONS

Final Office Action issued in related U.S. Appl. No. 14/838,597, dated Nov. 22, 2016, 19 pages.
Office Action (Notice of Allowance), issued in related U.S. Appl. No. 14/838,597, dated Jun. 26, 2017.
European Search Report issued in EP 16 19 1126.8, dated Apr. 5, 2017.

* cited by examiner

LIQUID CARTRIDGE

CROSS REFERENCE TO RELATED APPLICATION

This application claims priority under 35 U.S.C. § 119 from Japanese Patent Application No. 2016-072384 filed on Mar. 31, 2016. The entire subject matter of the application is incorporated herein by reference.

FIELD OF DISCLOSURE

The disclosure relates to a liquid cartridge configured to store liquid.

BACKGROUND

There has been known an ink cartridge including a remaining amount detecting portion having a prism. The remaining amount detecting portion is disposed in a storage chamber in which ink is stored. In the ink cartridge, it is determined, based on whether reflection of light emitted toward the remaining amount detecting portion from a light emitting portion has reached a light receiving portion, whether a remaining amount of ink stored in the storage chamber is low or not. The light emitting portion and the light receiving portion are disposed in a printer to which the ink cartridge is attached. In a state where the remaining amount of ink stored in the storage chamber is high and the remaining amount detecting portion is full of ink, in the ink cartridge, light emitted toward the remaining amount detecting portion is refracted at an ink layer in the remaining amount detecting portion and all is reflected off an inner wall of the remaining amount detecting portion. Therefore, no light reaches the light receiving portion. In a state where the remaining amount of ink stored in the storage chamber is low and the remaining amount detecting portion is empty of ink, light emitted toward the remaining amount detecting portion travels in straight lines in an air layer in the remaining amount detecting portion. Thus, the light reaches the light receiving portion.

SUMMARY

In accordance with aspects of the present disclosure, a liquid cartridge includes a liquid supply port configured to provide communication between an interior and an exterior of the liquid cartridge, a first storage chamber having a first communication opening, a second storage chamber extending between the communication opening of the first storage chamber and the liquid supply port, and a prism in the second chamber. The prism has a first inclined surface configured to change the state of received light in response to a level of liquid contained in the second chamber.

In accordance with further aspects of the disclosure, a liquid cartridge includes a liquid supply port configured to provide communication between an interior and an exterior of the liquid cartridge, a first wall having the liquid supply port, and a second wall spaced from the first wall. A first storage chamber is between the first and second walls, and a second storage chamber is between the first and second walls communicating with both the liquid supply port and the first storage chamber. A prism is in the second storage chamber, and the prism has an inclined surface configured to change the state of received light in response to a level of liquid contained in the second storage chamber. The prism is positioned between the first and second walls and above the first storage chamber.

In accordance with still further aspects of the disclosure, a liquid cartridge includes a liquid supply port configured to provide communication between an interior and an exterior of the liquid cartridge, a storage chamber, and a prism in the storage chamber. The prism has an inclined surface configured to change the state of received light in response to a level of liquid contained in the storage chamber. A reflector is positioned below the prism and is configured to reflect received light towards the prism.

DETAILED DESCRIPTION

Figure 1:
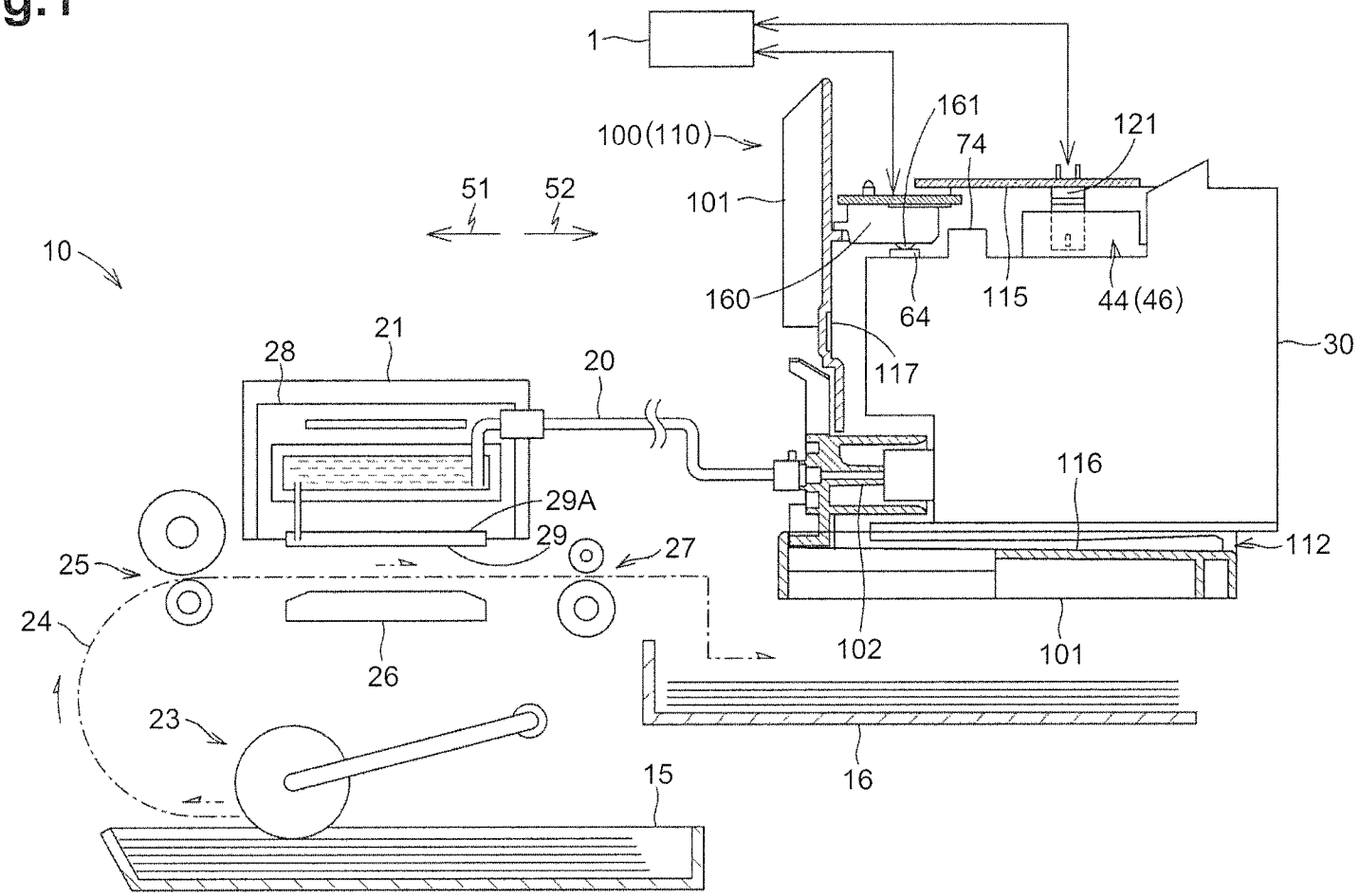
FIG. 1 is a schematic sectional view illustrating an internal configuration of a printer including a cartridge mounting portion.

Hereinafter, an embodiment of the disclosure will be described with reference to the accompanying drawings. While the disclosure is described in detail with reference to specific embodiments thereof, this is merely an example. Needless to say, various changes, arrangements and modifications may be applied therein without departing from the spirit and scope of the disclosure.

In the description below, a direction that an ink cartridge 30 is inserted into a cartridge mounting portion 110 is defined as a frontward direction 51. A direction that is opposite to the frontward direction 51 and that the ink cartridge 30 is removed from the cartridge mounting portion 110 is defined as a rearward direction 52. In the embodiment, both of the frontward direction 51 and the rearward direction 52 are the horizontal direction but might not necessarily be the horizontal direction.

A direction orthogonal to the frontward direction 51 and the rearward direction 52 is defined as an upward direction 54. A direction opposite to the upward direction 54 is defined as a downward direction 53. In the embodiment, the upward direction 54 is an upward direction in the vertical direction and the downward direction 53 is a downward direction in the vertical direction. Nevertheless, the upward direction 54 and the downward direction 53 might not necessarily be the vertical direction.

Directions orthogonal to the frontward direction 51 and the downward direction 53 are defined as a rightward direction 55 and a leftward direction 56, respectively. More specifically, in a state where the ink cartridge 30 is completely mounted on the cartridge mounting portion 110 (e.g., in a state where the ink cartridge 30 is in a use position), when the ink cartridge 30 is viewed along the frontward direction 51, i.e., when the ink cartridge 30 is viewed from the rear, the direction pointing to the right is defined as the rightward direction 55 and the direction pointing to the left is defined as the leftward direction 56. In the embodiment, both of the rightward direction 55 and the leftward direction 56 are the horizontal direction but might not necessarily be the horizontal direction.

[Overview of Printer 10]

As illustrated in FIG. 1, a printer 10 is configured to record an image onto a sheet by selectively ejecting ink droplets onto the sheet using an inkjet recording system. The printer 10 includes a recording head 21, an ink supply device 100, and an ink tube 20. The ink tube 20 connects between the recording head 21 and the ink supply device 100. The ink supply device 100 includes a cartridge mounting portion 110. The cartridge mounting portion 110 is configured to accommodate an ink cartridge 30 (as an example of a liquid cartridge). The cartridge mounting portion 110 has an opening 112 at one end. The ink cartridge 30 is inserted into the cartridge mounting portion 110 along the frontward direction 51 through the opening 112 or is removed from the cartridge mounting portion 110 along the rearward direction 52 through the opening 112.

The ink cartridge 30 stores ink (as an example of liquid) that can be used in the printer 10. In a state where the ink cartridge 30 has been completely mounted on the cartridge mounting portion 110, the ink cartridge 30 and the recording head 21 are connected with each other via the ink tube 20. The recording head 21 includes a sub tank 28. The sub tank 28 temporarily stores therein ink supplied thereto from the ink cartridge 30 through the ink tube 20. The recording head 21 ejects, from nozzles 29 selectively, ink supplied from the sub tank 28. More specifically, a head control board mounted on the recording head 21 applies drive voltage selectively to piezoelectric elements 29A provided for the respective nozzles 29, whereby ink is ejected from appropriate nozzles 29 selectively.

The printer 10 further includes a feed tray 15, a feed roller 23, a conveyor roller pair 25, a platen 26, a discharge roller pair 27, and a discharge tray 16. A sheet fed into a conveyance path 24 by the feed roller 23 is conveyed onto the platen 26 by the conveyor roller pair 25. The recording head 21 selectively ejects ink onto the sheet that is passing over the platen 26, thereby recording an image onto the sheet. Through ink ejection, ink stored in the ink cartridge 30 completely mounted on the cartridge mounting portion 110 is reduced. The sheet passed over the platen 26 is then discharged onto the discharge tray 16 disposed at a downstream end of the conveyance path 24, by the discharge roller pair 27.

[Ink Supply Device 100]

As illustrated in FIG. 1, the ink supply device 100 is included in the printer 10. The ink supply device 100 is configured to supply ink to the recording head 21 of the printer 10. The ink supply device 100 includes the cartridge mounting portion 110 for accommodating the ink cartridge 30. FIG. 1 illustrates a state where the ink cartridge 30 is completely mounted on the cartridge mounting portion 110.

[Cartridge Holder 110]

Figure 2:
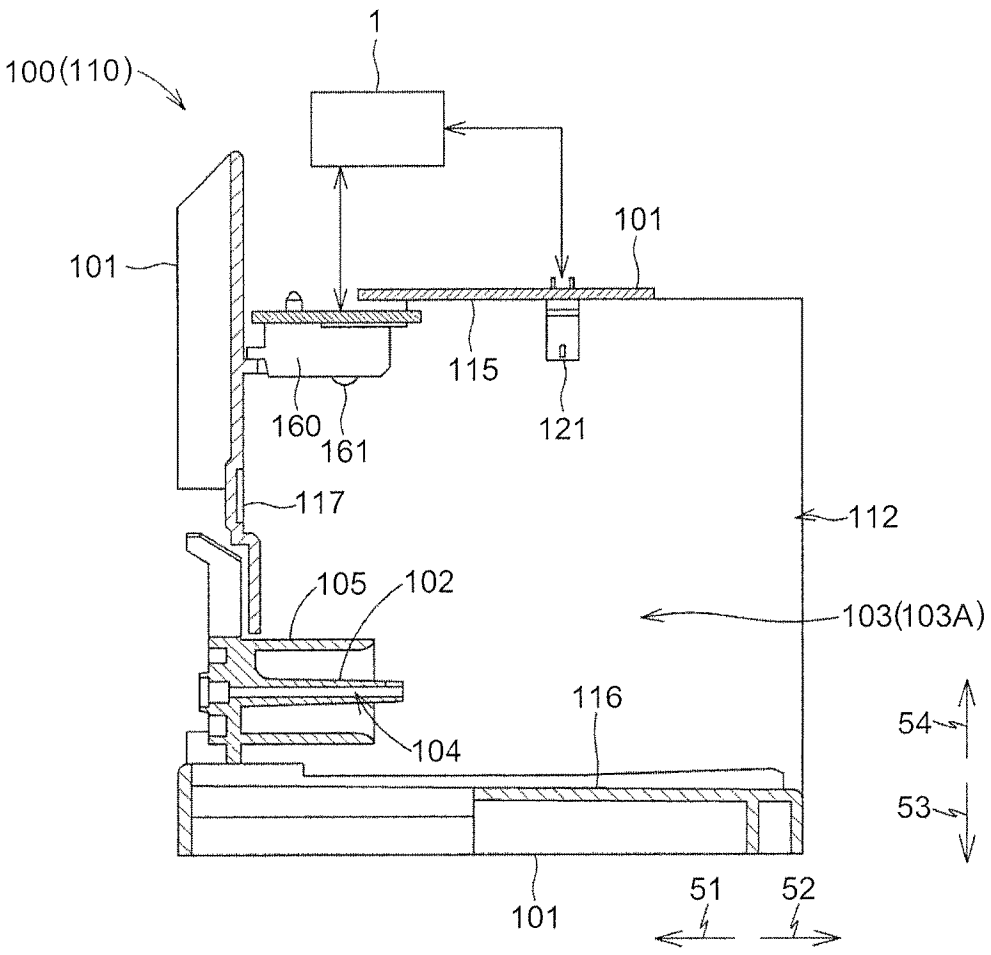
FIG. 2 is a schematic cross-sectional view illustrating the cartridge mounting portion 110.

As illustrated in FIG. 2, the cartridge mounting portion 110 includes a casing 101, an ink needle 102 (refer to FIG. 1), an optical sensor 121, and a contact unit 160.

The casing 101 is divided into four compartment spaces 103A that are arranged side by side in the rightward and leftward directions 55 and 56. The casing 101 is configured to accommodate four ink cartridges 30 of respective colors, e.g., cyan, magenta, yellow, and black, in the respective compartment spaces 103A.

In the description below, the ink needle 102, the optical sensor 121, and the contact unit 160 are provided for each of the ink cartridges 30. That is, in the embodiment, four each of the ink needle 102, the optical sensor 121, and the contact unit 160 are provided. The same components of the ink needles 102, the optical sensors 121, and the contact units 160 are disposed side by side in the rightward and leftward directions 55 and 56. The same components of the ink needles 102, the optical sensors 121, and the contact units 160 have an identical configuration. Therefore, one of the same components of the ink needles 102, the optical sensors 121, and the contact units 160 will be described in detail, and a description for the others will be omitted.

[Casing 101]

As illustrated in FIG. 2, the casing 101 defines a housing of the cartridge mounting portion 110. The casing 101 has a box shape with an opening 112, and has a top surface 115, a bottom surface 116, and a far-end surface 117. The top surface 115 defines a top end of an internal space 103 of the casing 101. The bottom surface 116 defines a bottom end of the internal space 103 of the casing 101. The far-end surface 117 defines a front end of the internal space 103 of the casing 101 with respect to the frontward direction 51. The far-end surface 117 connects between the top surface 115 and the bottom surface 116. The opening 112 is defined behind the far-end surface 117 in the rearward direction 52 and opposite to the far-end surface 117. The opening 112 may be exposed at a user interface of the printer 10 which faces the user at the time the user uses the printer 10. The ink cartridges 30 are inserted into or removed from the casing 101 through the opening 112. The casing 101 includes three plates (not illustrated) that divide the internal space 103 into the four compartment spaces 103A having a longer length in the vertical direction. The ink cartridges 30 are configured to be accommodated in the respective compartment spaces 103A divided by the plates.

The opening 112 of the casing 101 may be closed and exposed by a cover (not illustrated). The cover is attached to a rotating shaft (not illustrated) that extends in the rightward and leftward directions 55 and 56 at a vicinity of a lower end of the opening 112. This configuration enables the cover to pivot on the rotating shaft between a closed position at which the cover closes the opening 112 and an open position at which the cover exposes the opening 112. When the cover is located at the open position, the user is allowed to insert or remove one or more ink cartridges 30 into or from the cartridge mounting portion 110 through the opening 112. When the cover is located at the closed position, the user is not allowed to insert or remove any ink cartridge 30 into or from the cartridge mounting portion 110. Further, the user is not allowed to access any ink cartridge 30 mounted on the casing 101.

A cover sensor 118 (refer to FIG. 10) is disposed at a vicinity of an upper end of the opening 112 of the casing 101. The cover sensor 118 may detect whether the cover sensor 118 is in contact with the cover. When the cover is located at the closed position, an upper end portion of the cover is in contact with the cover sensor 118 and the cover sensor 118 outputs a detection signal to a controller 1 (refer to FIGS. 1 and 10). When the cover is not located at the closed position, the cover sensor 118 does not output a detection signal.

[Ink Needle 102]

As illustrated in FIG. 2, the ink needle 102 is a resin hollow tube and is disposed at a lower portion of the far-end surface 117 of the casing 101. The ink needle 102 is disposed at a particular position at the far-end surface 117 of the casing 101 such that the location of the ink needle 102 matches an ink supply portion 34 (refer to FIG. 3) of an ink cartridge 30 mounted on the cartridge mounting portion 110. The ink needle 102 protrudes in the rearward direction 52 from the far-end surface 117 of the casing 101.

A cylindrical guide portion 105 is disposed surrounding the ink needle 102. The guide portion 105 protrudes in the rearward direction 52 from the far-end surface 117 of the casing 101 and has an opening at its protruding end. The ink needle 102 is disposed at the center of the guide portion 105. The guide portion 105 has an appropriate shape for receiving entry of the ink supply portion 34 of the ink cartridge 30 thereinto.

While an ink cartridge 30 is being inserted into the cartridge mounting portion 110 in the frontward direction 51, i.e., while an ink cartridge 30 is being moved toward a completely mounted position in the cartridge mounting portion 110, the ink supply portion 34 of the ink cartridge 30 enters the guide portion 105. As the ink cartridge 30 is further inserted in the frontward direction 51 to the cartridge mounting portion 110 after the ink supply portion 34 of the ink cartridge 30 enters the guide portion 105, the ink needle 102 penetrates an ink supply port 71 of the ink supply portion 34. Thus, the ink needle 102 and the ink supply portion 34 are connected to each other. Ink stored in a storage chamber 36 and an ink channel 44 (refer to FIGS. 4A and 4B) defined inside the ink cartridge 30 flows into the ink tube 20 connected to the ink needle 102 through an internal space 106 (refer to FIG. 4A) of the ink supply portion 34 and an internal space 104 of the ink needle 102. The ink needle 102 may have a flat end or a pointed end.

[Optical Sensor 121]

As illustrated in FIG. 2, the optical sensor 121 is disposed at the top surface 115 of the casing 101.

Figure 4B:
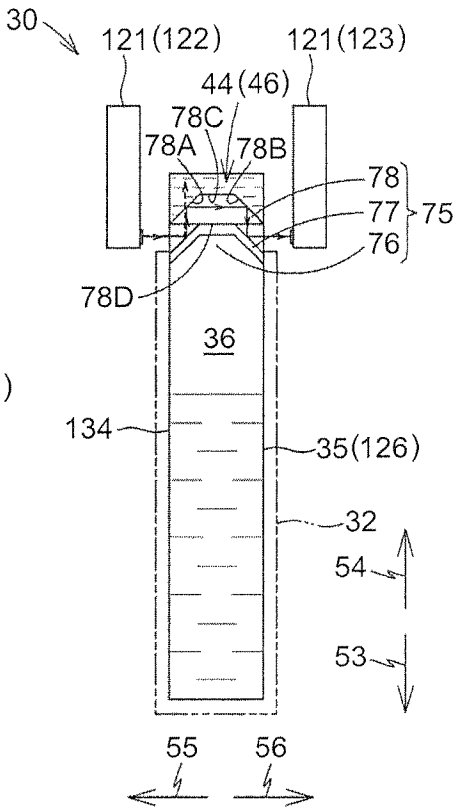
FIG. 4B is a schematic sectional view taken along line IV-IV of FIG. 4A.

As illustrated in FIG. 4B, the optical sensor 121 includes a light emitting portion 122 and a light receiving portion 123. The light emitting portion 122 and the light receiving portion 123 face each other. The light emitting portion 122 is disposed at a right end portion of one of the partitioned compartment spaces 103A in the internal space 10. The light receiving portion 123 is disposed at a left end portion of the same one of the partitioned compartment spaces 103A in the internal space 10. The locations of the light emitting portion 122 and the light receiving portion 123 may be exchanged to each other.

As illustrated in FIG. 2, the optical sensor 121 is electrically connected to the controller 1 of the printer 10 via an electrical circuit. The controller 1 will be described later.

[Contact Unit 160]

As illustrated in FIG. 2, the contact unit 160 is disposed at the top surface 115 of the casing 101. The contact unit 160 is disposed further to the front than optical sensor 121 in the frontward direction 51. In other words, the contact unit 160 is disposed at a front end portion of the top surface 115. The contact unit 160 is disposed at a particular location where, in a state where the ink cartridge 30 is mounted on the cartridge mounting portion 110, the contact unit 160 is positioned above a circuit board 64 (refer to FIG. 4A) of the ink cartridge 30 with facing the circuit board 64.

The contact unit 160 includes a contact 161 at its lower surface. The contact 161 is disposed corresponding to a location of an electrode (not illustrated) mounted on an upper surface of the circuit board 64. An arbitrary number of contacts 161 and electrodes may be provided.

The contact 161 is electrically connected to the controller 1 (refer to FIGS. 1 and 10) of the printer 10 via the electrical circuit. Establishment of electrical continuity between the contact 161 and the electrode provides establishment of electrical continuity between the controller 1 and an IC of the ink cartridge 30.

[Ink Cartridge 30]

Figure 3:
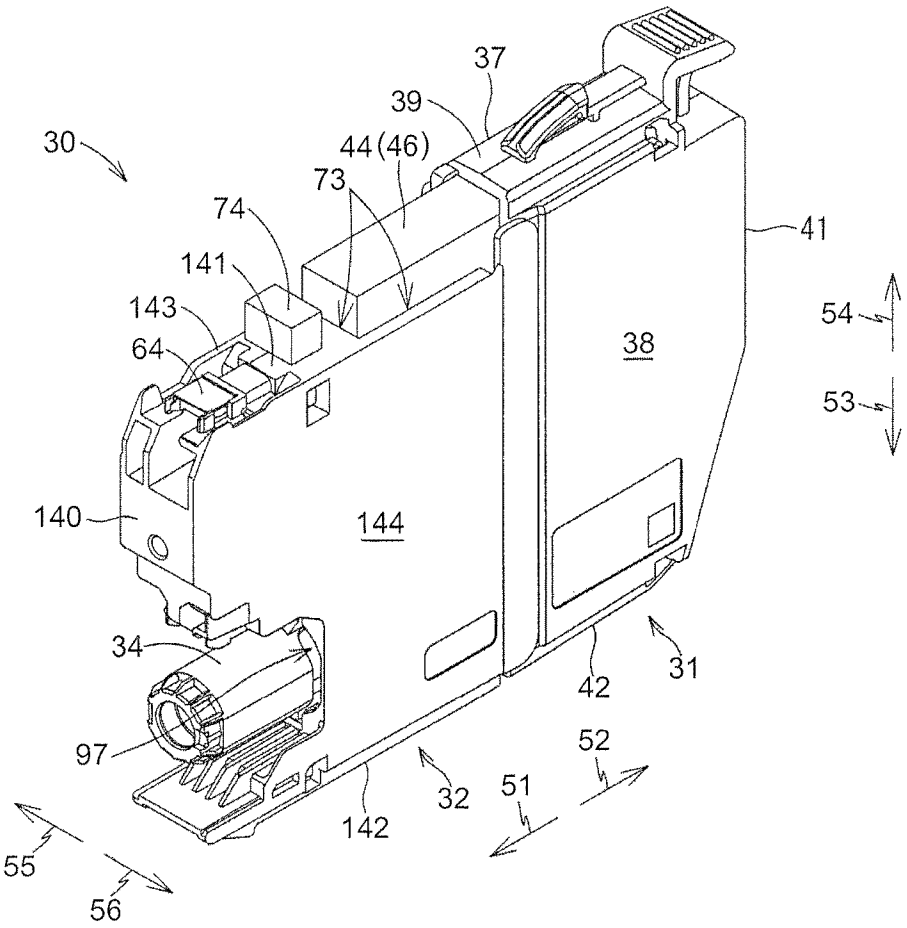
FIG. 3 is a perspective view of an ink cartridge.

An ink cartridge 30 illustrated in FIGS. 3 and 4 is a container for storing liquid such as ink. Spaces provided inside the ink cartridge 30 include the storage chamber 36 and an ink channel 44 for storing ink. The storage chamber 36 and the ink channel 44 are defined by an internal frame 35 accommodated in a rear cover 31 and a front cover 32 both that define an exterior of the ink cartridge 30. Nevertheless, the storage chamber 36 and the ink channel 44 may be defined by, for example, the rear cover 31 and the front cover 32.

An orientation of the ink cartridge 30 illustrated in FIGS. 1, 3, 4A, and 4B corresponds to an orientation of the ink cartridge 30 completely mounted on the cartridge mounting portion 110. The ink cartridge 30 includes a front face 140, a rear face 41, upper faces 39 and 141, lower faces 42 and 142, side faces 37 and 143, and the other side faces 38 and 144. The ink cartridge 30 illustrated in FIGS. 1, 3, and 4 is oriented such that a direction from the rear face 41 toward the front face 140 coincides with the frontward direction 51, a direction from the front face 140 toward the rear face 41 coincides with the rearward direction 52, a direction from the upper faces 39 and 141 toward the lower faces 42 and 142 coincides with the downward direction 53, and a direction from the lower faces 42 and 142 toward the upper faces 39 and 141 coincides with the upward direction 54. While the ink cartridge 30 is inserted into and mounted on the cartridge mounting portion 110, the front face 140 faces the frontward direction 51, the rear face 41 faces the rearward direction 52, the side faces 37 and 143 face the rightward direction 55, the side faces 38 and 144 face the leftward direction 56, the lower faces 42 and 142 face the downward direction 53, and the upper faces 39 and 141 face the upward direction 54.

As illustrated in FIGS. 3 and 4, the ink cartridge 30 includes the rear cover 31, the front cover 32, and the internal frame 35. The rear cover 31 has a substantially rectangular parallelepiped shape. The front cover 32 includes the front face 140. The internal frame 35 defines the storage chamber 36 and the ink channel 44. The rear cover 31 and the front cover 32 are attached to the internal frame 35 to define the exterior of the ink cartridge 30. The internal frame 35 is accommodated in the rear cover 31 and the front cover 32. The ink cartridge 30 is narrow in a dimension with respect to the rightward and leftward directions 55 and 56 and has larger dimensions with respect to the downward and upward directions 53 and 54 and the frontward and rearward directions 51 and 52 than the dimension with respect to the rightward and leftward directions 55 and 56. The rear face 41 is disposed opposite to the front face 140 of the front cover 32 across the storage chamber 36.

An exterior of the ink cartridge 30 includes six surfaces including the front face 140, the rear face 41, the upper faces 39 and 141, the lower faces 42 and 142, the side faces 37 and 143, and the side faces 38 and 144 mainly. The surface including the side faces 37 and 143 and the surface including the side faces 38 and 144 each have the largest area among the six surfaces. The front face 140 and the rear face 41 each extend in the upward and downward directions 54 and 53 and in the rightward and leftward directions 55 and 56. The upper faces 39 and 141 and the lower faces 42 and 142 each extend in the frontward and rearward directions 51 and 52 and in the rightward and leftward directions 55 and 56. The side faces 37 and 143 and the side faces 38 and 144 each extend in the frontward and rearward directions 51 and 52 and in the upward and downward directions 54 and 53.

Each of the front, rear, upper, lower, and side surfaces of the ink cartridge 30 might not necessarily be constituted of a single face. That is, the front surface is a surface that is visually recognized when the ink cartridge 30 is viewed along the rearward direction 52 and that is located further to the front in the frontward direction 51 than the center of the ink cartridge 30 in the frontward and rearward directions 51 and 52. The rear surface is a surface that is visually recognized when the ink cartridge 30 is viewed along the frontward direction 51 and that is located further to the rear in the rearward direction 58 than the center of the ink cartridge 30 in the frontward and rearward directions 51 and 52. The upper surface is a surface that is visually recognized when the ink cartridge 30 is viewed along the downward direction 53 and that is located at a higher level in the upward direction 54 than the center of the ink cartridge 30 in the downward and upward directions 53 and 54. The lower surface is a surface that is visually recognized when the ink cartridge 30 is viewed along the upward direction 54 and that is located at a lower level in the downward direction than the center of the ink cartridge 30 in the downward and upward directions 53 and 54. The side surfaces are defined similarly. In the embodiment, the upper face 39 located further to the rear than the upper face 141 is located at a higher level than the upper face 39. Nevertheless, the upper faces 39 and 141 may be located at the same level in the upward and downward directions 54 and 53.

[Rear Cover 31]

As illustrated in FIG. 3, the rear cover 31 includes the side faces 37 and 38, the upper face 39, and the lower face 42 that extend in the frontward direction 51 from the rear face 41. The side faces 37 and 38 are spaced apart from each other in the rightward and leftward directions 55 and 56. The upper face 39 faces the upward direction 54 and the lower face 42 faces the downward direction 53. The rear cover 31 has a box shape with an opening facing the frontward direction 51. The rear cover 31 with the opening enables the internal frame 35 to be inserted into the interior thereof through the opening. That is, the rear cover 31 covers a rear portion of the internal frame 35.

[Front Cover 32]

As illustrated in FIG. 3, the front cover 32 includes the side faces 143 and 144, the upper face 141, and the lower surface 142 that extend in the rearward direction 52 from the front face 140. The side faces 143 and 144 are spaced apart from each other in the rightward and leftward directions 55 and 56. The upper face 141 and the lower surface 142 are spaced apart from each other in the downward and upward directions 53 and 54. The front cover 32 has a box shape with an opening facing the rearward direction 52. The front cover 32 with the opening enables the internal frame 35 to be inserted into the interior thereof through the opening. That is, the front cover 32 covers a front portion of the internal frame 35 that is the remainder portion of the internal frame 35 which is not covered by the rear cover 31.

The front cover 32 has an opening 97 at a lower portion of the front face 140. The opening 97 penetrates the lower portion of the front face 140 in the rearward direction 52. The opening 97 exposes therethrough the ink supply portion 34 of the internal frame 35 in a state where the internal frame 35 is attached to the front cover 32. Therefore, the opening 97 is defined at a location appropriate for the ink supply portion 34 of the internal frame 35 and has a size and shape appropriate for the ink supply portion 34 of the internal frame 35.

The front cover 32 supports the circuit board 64 at a front end portion of the upper face 141 thereof. The circuit board 64 includes an electrode (as an example of an electrical interface) on its upper surface. The electrode include, for example, a clock electrode, a data electrode, a power supply voltage electrode, and a ground electrode. The circuit board 64 includes an IC (not illustrated), for example, that is electrically connected to the electrode. The IC is a semiconductor integrated circuit and stores data readably therefrom. The data indicates information regarding the ink cartridge 30 (e.g., a lot number and/or a date of manufacture) and/or information regarding ink (e.g., ink color). In some examples, the circuit board 64 is rigid and has an IC mounted thereon in a Chip On Board (COB) arrangement. In other examples, the circuit board 64 is flexible in which case the circuit board 64 has a Chip On Film (COF) construction.

In a state where the ink cartridge 30 is completely mounted on the cartridge mounting portion 110, the electrode is electrically continuous with the contact 161 (refer to FIG. 2) of the contact unit 160. Therefore, the circuit board 64 is electrically connected to the controller 1 via the electrode, the contact unit 160, and the electrical circuit (refer to FIG. 1).

The upper face 141 of the front cover 32 has an opening 73 and a raised portion 74.

The opening 73 is defined in a rear end portion of the upper face 141. The opening 73 exposes a second channel 46 of the internal frame 35 and a remaining amount detecting portion 75 (refer to FIG. 4B) disposed in the second channel 46 to the outside in a state where the internal frame 35 is attached to the front cover 32. Therefore, the opening 73 is defined at a location appropriate for the second channel 46 and has a size and shape appropriate for the second channel 46.

The raised portion 74 is disposed between the circuit board 64 and the opening 73 at the upper face 141. The raised portion 74 protrudes in the upward direction 54 from the upper face 141. The raised portion 74 has a size and shape capable of obstructing a path for light emitted from the light emitting portion 122 toward the light receiving portion 123 when the raised portion 74 is positioned between the light emitting portion 122 and the light receiving portion 123 of the optical sensor 121. The raised portion 74 has a substantially rectangular parallelepiped shape. Nevertheless, the raised portion 74 may have another shape.

[Internal Frame 35]

The internal frame 35 has a box shape with its right end opened. As illustrated in FIG. 4, the internal frame 35 has a left wall 126, a lower wall 127, an outer front wall 128 (as an example of a first wall), an outer rear wall 129 (as an example of a second wall), an outer upper wall 130, an inner front wall 131, an inner rear wall 132, and an inner upper wall 133 (as an example of a third wall). The right open end of the internal frame 35 is closed by a film 134 (refer to FIGS. 5A and 5B), thereby defining the storage chamber 36 (as an example of a first storage chamber) and the ink channel 44 (as an example of a second storage chamber and an example of a liquid channel) that are capable of storing ink therein.

The left wall 126 extends in the frontward and rearward directions 51 and 52 and in the upward and downward directions 54 and 53. The lower wall 127 extends in the rightward direction 55 from a lower end of the left wall 126. The lower wall 127 extends in the frontward and rearward directions 51 and 52 and in the rightward and leftward directions 55 and 56.

The outer front wall 128 extends in the rightward direction 55 from a front end of the left wall 126. The outer rear wall 129 extends in the rightward direction 55 from a rear end of the left wall 126. That is, the outer rear wall 129 is spaced from the outer front wall 128 in the rearward direction 52. The outer upper wall 130 extends in the rightward direction 55 from an upper end of the left wall 126. A lower end of the outer front wall 128 is contiguous to the lower wall 127. An upper end of the outer front wall 128 is contiguous to the outer upper wall 130. A lower end of the outer rear wall 129 is contiguous to the lower wall 127. An upper end of the outer rear wall 129 is contiguous to the outer upper wall 130.

The inner front wall 131 extends in the rightward direction 55 from a position where corresponds to a front end portion of the left wall 126 and where is located further to the rear than the outer front wall 128 in the rearward direction 52. The inner rear wall 132 extends in the rightward direction 55 from a position where corresponds to a rear end portion of the left wall 126 and where is located further to the front than the outer rear wall 129 in the frontward direction 51. The inner upper wall 133 extends in the rightward direction 55 from a position where corresponds to an upper end portion of the left wall 126 and where is located at a lower level than the outer upper wall 130 in the downward direction 53. The inner upper wall 133 is disposed between the outer front wall 128 and the outer rear wall 129. A lower end of the inner front wall 131 is spaced from the lower wall 127 in the upward direction 54. An upper end of the inner front wall 131 is contiguous to the inner upper wall 133. A lower end of the inner rear wall 132 is spaced from the lower wall 127 in the upward direction 54. An upper end of the inner rear wall 132 is contiguous to the inner upper wall 133.

The outer front wall 128, the outer rear wall 129, the inner front wall 131, and the inner rear wall 132 each extend in the rightward and leftward directions 55 and 56 and in the upward and downward directions 54 and 53. The outer upper wall 130 and the inner upper wall 133 each extend in the frontward and rearward directions 51 and 52 and in the rightward and leftward directions 55 and 56.

Figure 5B:
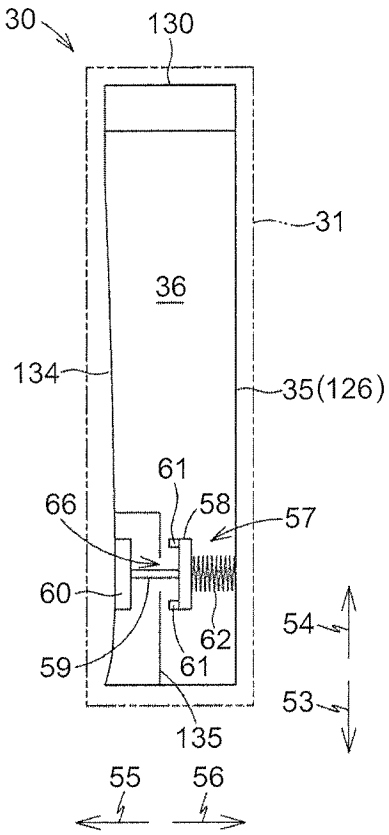
FIG. 5B is a sectional view taken along line V-V of FIG. 4A, wherein the opening is opened.
Figure 5A:
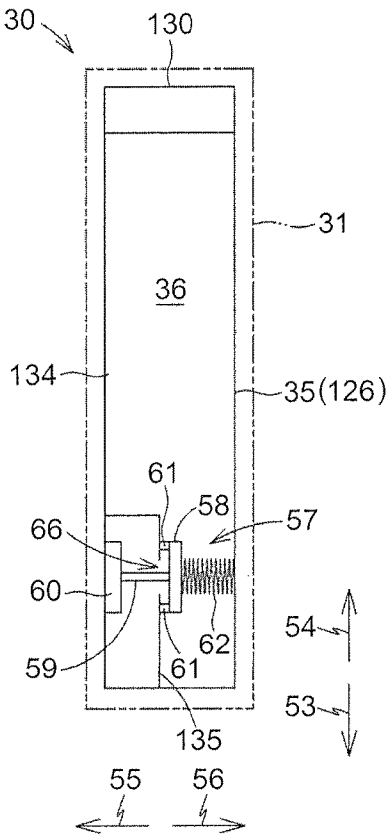
FIG. 5A is a sectional view taken along line V-V of FIG. 4A, wherein an opening is closed.

The storage chamber 36 is defined by the left wall 126, the lower wall 127 (as an example of a bottom wall), the inner front wall 131, the inner rear wall 132, the inner upper wall 133, and the film 134 (refer to FIGS. 5A and 5B). A lower front end portion and a lower rear end portion of the storage chamber 36 are defined by the outer front wall 128 and the outer rear wall 129, respectively. That is, the storage chamber 36 is positioned below the inner upper wall 133. Also the storage chamber 36 is positioned between the outer front wall 128 and the outer rear wall 129. Also the storage chamber 36 is positioned above the lower inner wall 127.

The ink channel 44 is defined by the left wall 126, the outer front wall 128, the inner front wall 131, the outer rear wall 129, the inner rear wall 132, the outer upper wall 130, the inner upper wall 133, and the film 134 (refer to FIGS. 5A and 5B). That is, the ink channel 44 is partially positioned above the inner upper wall 133. Also, the ink channel 44 is positioned between the outer front wall 128 of the internal frame 35 and the outer rear wall 129 of the internal frame 35. It is noted that the ink channel is positioned above the lower inner wall 127.

In the embodiment, the storage chamber 36 and the ink channel 44 are each defined by appropriate walls and the film 134. Nevertheless, the configuration of each of the storage chamber 36 and the ink channel 44 is not limited to the specific example. For example, each of the storage chamber 36 and the ink channel 44 may be constituted of a bag made by a film only.

In the embodiment, the storage chamber 36 of the internal frame 35 covered by the front cover 32 and the rear cover 31 is defined by the left wall 126, the lower wall 127, the inner front wall 131, the inner rear wall 132, the inner upper wall 133, and the film 134. Nevertheless, the front cover 32 and the rear cover 31 might not necessarily be needed. That is, surfaces of the walls defining the storage chamber 36 may be exposed and the circuit board 64 may be disposed on one of the exposed surfaces of the walls.

[Ink Channel 44]

The ink channel 44 surrounds the storage chamber 36 from the rearward direction 52, the upward direction 54, and the frontward direction 51 in side view. The ink channel 44 includes a first channel 45, a second channel 46, and a third channel 47. The first channel 45 is located behind the storage chamber 36 in the rearward direction 52. The second channel 46 is located above the storage chamber 36 in the upward direction 54 and is contiguous to an upper end of the first channel 45. The third channel 47 is located in front of the storage chamber 36 in the frontward direction 51 and is contiguous to a front end of the second channel 46. So, the ink channel 44 is partially positioned above the storage chamber 36. Also an upper end of the ink channel 44 is positioned higher than an upper end of the storage chamber 36.

An upper end of the ink channel 44 is at a higher level than an upper end of the storage chamber 36. That is, the ink channel 44 is disposed such that a maximum ink level in the ink channel 44 is higher than a maximum ink level in the storage chamber 36.

The ink channel 44 is capable of communicating with the storage chamber 36 via an opening 66 (refer to FIGS. 5A and 5B). The ink channel 44 is capable of communicating with the internal space 106 of the ink supply portion 34 via the opening 72. That is, the ink channel 44 extends between the storage chamber 36 and the ink supply portion 34.

Figure 4A:
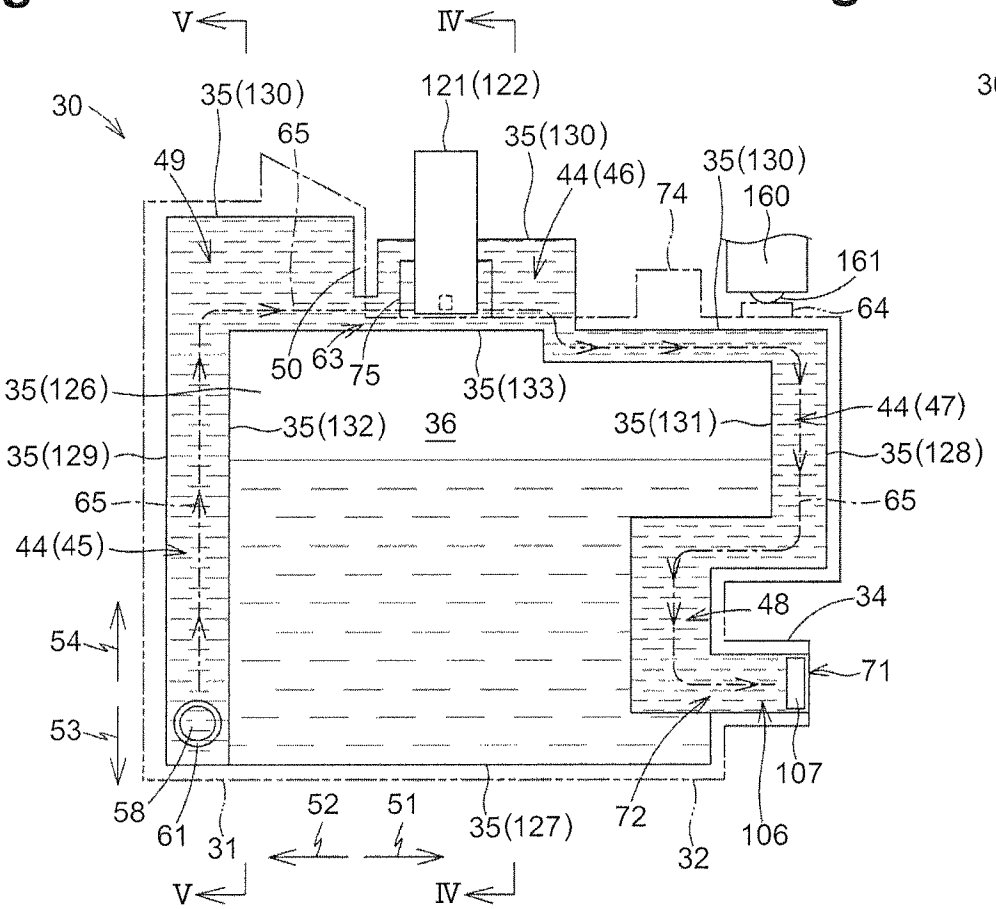
FIG. 4A is a schematic cross-sectional view of the ink cartridge.

As illustrated in FIGS. 4A and 4B, the opening 66 (as an example of a first communication opening) is defined at a lower end portion of the first channel 45. As illustrated in FIG. 4A, the opening 72 is defined at a lower end portion of the third channel 47. That is, ink stored in the storage chamber 36 flows in the upward direction 54 from the opening 66 and then flows in the frontward direction 51. After that, ink further flows in the downward direction 53 and reaches the opening 72. That is, ink flows in the ink channel 44 along a flow direction 65 indicated by a dot-and-dashed line in FIG. 4A. A length of the ink channel 44 along the flow direction 65 is longer than a perimeter of a cross-section of the ink channel 44 cut in a direction orthogonal to the flow direction 65.

The remaining amount detecting portion 75 (refer to FIG. 4B) is disposed at a middle portion of the second channel 46 in the frontward and rearward directions 51 and 52. The remaining amount detecting portion 75 will be described in detail later.

A lower end portion of the third channel 47 extends in the rearward direction 52 further than the other portions of the third channel 47. This configuration provides a first buffer chamber 48 at the lower end portion of the third channel 47. The first buffer chamber 48 is disposed between the remaining amount detecting portion 75 and the opening 72 in the ink channel 44.

A rear end portion of the second channel 46 extends in the upward direction 54 further than the other portions of the second channel 46. This configuration provides a second buffer chamber 49 at the rear end portion of the second channel 46. The second buffer chamber 49 is disposed between the remaining amount detecting portion 75 and the storage chamber 36 in the ink channel 44.

In the vicinity of the remaining amount detecting portion 75 and between the remaining amount detecting portion 75 and the second buffer chamber 49 of the second channel 46, a projection 50 protrudes in the downward direction 53 from a top surface defining the second channel 46, which provides a communication port 63 for providing communication between the second buffer chamber 49 and the remaining amount detecting portion 75. A cross-sectional area of the ink channel 44 at the communication port 63 which is defined in the vicinity of the remaining amount detecting portion 75 in the ink channel 44 is smaller than a cross-sectional area of the ink channel 44 at the other portions thereof. In the embodiment, the communication port 63 is located at a lower level than the upper surface of the second buffer chamber 49. Therefore, this configuration may restrict intrusion of air bubbles accumulating at an upper portion of the second buffer chamber 49 into the remaining amount detecting portion 75 through the communication port 63. The projection 50 may protrude from any surface other than the top surface of the second channel 46 or may protrude from a plurality of surfaces including the top surface (e.g., all of the top surface, a right surface, a left surface, and a bottom surface defining the second channel 46).

[Ink Supply Portion 34]

As illustrated in FIG. 4A, the ink supply portion 34 (as an example of a liquid supply portion) that protrudes in the frontward direction 51 is disposed at a lower portion of the outer front wall 128. So, the ink supply portion 34 protrudes from the outer front wall 128 toward the exterior of the ink cartridge 30. The ink supply portion 34 has a substantially cylindrical shape. The ink supply portion 34 has the ink supply port 71 (as an example of a liquid supply port) at its front end. The ink supply port 71 provides communication between the internal space 106 of the ink supply portion 34 and the exterior of the ink cartridge 30. The ink supply portion 34 has the opening 72 at its rear end. The opening 72 provides communication between the third channel 47 of the ink channel 44 and the internal space 106. Also the opening 72 communicates the third channel 47 at a lower side of the third channel 47. Also, the ink supply portion 34 and the ink supply port 71 is positioned below the upper inner wall 133.

The ink supply portion 34 includes a valve 107 in the internal space 106. The valve 107 is closed in a specific condition. Therefore, ink stored in the ink channel 44 is prevented from leaking to the outside of the ink cartridge 30. During insertion of the ink cartridge 30 into the cartridge mounting portion 110 in the frontward direction 51, the ink needle 102 (refer to FIG. 2) is inserted into the internal space 106 of the ink supply portion 34 from the ink supply port 71 with pressing the valve 107 to open the valve 107. In response to the opening of the valve 107, ink stored in the ink channel 44 flows into the ink tube 20 connected with the ink needle 102 via the internal space 106 of the ink supply portion 34 and the internal space 104 (refer to FIG. 2) of the ink needle 102. The ink needle 102 has an opening (not illustrated) at its peripheral surface, and ink in the internal space 106 of the ink supply portion 34 may flow into the internal space 104 via the opening.

Nevertheless, the ink supply portion 34 is not limited to the configuration equipped with a valve. For example, the ink supply port 71 may be closed by a film. Upon mounting of the ink cartridge 30 on the cartridge mounting portion 110, the ink needle 102 may penetrate the film and a tip portion of the ink needle 102 may enter the internal space 106 of the ink supply portion 34 through the ink supply port 71.

[Differential Pressure Regulating Valve 57]

As illustrated in FIGS. 5A and 5B, a differential pressure regulating valve 57 is disposed between the storage chamber 36 and the first channel 45. The differential pressure regulating valve 57 is configured to open and close the opening 66 by moving by pressure difference caused between pressure in the storage chamber 36 and pressure in the first channel 45.

The differential pressure regulating valve 57 includes a body 58, a protrusion 59, a plate portion 60, a seal 61, and a coil spring 62.

The body 58 is disposed at a lower portion of the first channel 45 of the ink channel 44. An inner wall 135 is disposed further to the left than the film 134 in the leftward direction 56 and defines a lower left side of the first channel 45. The inner wall 135 has the opening 66. The body 58 faces the opening 66 in the rightward and leftward directions 55 and 56. The body 58 has a plate-like shape. The body 58 has a larger area at its right surface than an area of the opening 66.

The protrusion 59 extends in the rightward direction 55 from the center of the right surface of the body 58. The protrusion 59 extends to the storage chamber 36 from the plate portion 60 via the opening 66.

The plate portion 60 is disposed at the first channel 45. The plate portion 60 is adhered to a left surface of the film 134. The plate portion 60 faces the protrusion 59 in the rightward and leftward directions 55 and 56.

The seal 61 is a ring-shaped member adhered to the right surface of the body 58. The seal 61 is made of an elastic member, for example, rubber. The seal 61 is disposed surrounding the opening 66. The seal 61 and the body 58 are configured to close the opening 66 by contacting of the seal 61 with an edge of the opening 66.

One end of the coil spring 62 is in contact with the left surface of the body 58. The other end of the coil spring 62 is in contact with the left wall 126.

Hereinafter, behavior of the differential pressure regulating valve 57 will be described. As illustrated in FIG. 5A, when both of the storage chamber 36 and the ink channel 44 are at atmospheric pressure, the film 134 is maintained in a state where the film 134 extends in the frontward direction 51, the rearward direction 52, the upward direction 54, and the downward direction 53. In this state, the body 58 is urged by the coil spring 62 and the seal 61 contacts the edge of the opening 66. Therefore, the opening 66 is closed.

In this state, ink stored in the ink channel 44 is allowed to flow from the ink supply portion 34 to the ink tube 20. As ink comes out of the ink supply portion 34, pressure in the ink channel 44 becomes lower than atmospheric pressure. Therefore, as illustrated in FIG. 5B, the portion of the film 134 defining the right end of the ink channel 44 deforms to protrude in the leftward direction 56. In response to this, the plate portion 60 moves in the leftward direction 56 and the plate portion 60 presses the protrusion 59 in the leftward direction 56. Thus, the body 58, the plate portion 60, and the seal 61 move in the leftward direction 56 against an urging force of the coil spring 62, and the seal 61 becomes separate from the edge of the opening 66 to open the opening 66. As the opening 66 is opened, the storage chamber 36 and the ink channel 44 come into communication with each other and ink stored in the storage chamber 36 flows into the ink channel 44.

As the opening 66 is opened, pressure in the ink channel 44 becomes equal to atmospheric pressure again. Thus, the film 134 becomes restored and the plate portion 60 moves in the rightward direction 55. In response to this, the body 58, the plate portion 60, and the seal 61 move in the rightward direction 55 by the urging force of the coil spring 62 and the seal 61 contacts the edge of the opening 66 to close the opening 66.

Subsequent to this, the opening and closing of the opening 66 is repeated. More specifically, every time ink stored in the ink channel 44 is used, the opening 66 is opened to refill the ink channel 44 with ink from the storage chamber 36 and then the opening 66 is closed.

When the storage chamber 36 becomes empty of ink, the ink channel 44 is not refilled with ink any more. Then, irrespective of the pressure in the ink channel 44, ink stored in the ink channel 44 reduces. When ink stored in the ink channel 44 becomes less than a predetermined amount, the remaining amount detecting portion 75 detects that ink stored in the ink channel 44 has become less than the predetermined amount.

[Remaining Amount Detecting Portion 75]

As illustrated in FIGS. 4A and 4B, the remaining amount detecting portion 75 is disposed at a substantially middle portion of the second channel 46 in the frontward and rearward directions 51 and 52. The remaining amount detecting portion 75 is used for detecting a remaining amount of ink stored in the second channel 46.

The remaining amount detecting portion 75 is disposed at a higher level than the ink supply portion 34 in the upward direction 54 and further to the rear than the ink supply portion 34 in the rearward direction 52. The remaining amount detecting portion 75 is disposed between the outer front wall 128 and the outer rear wall 129 in the frontward and rearward directions 51 and 52. The remaining amount detecting portion 75 is disposed at a higher level than the inner upper wall 133 in the upward direction 54. The remaining amount detecting portion 75 is disposed at a higher level than the circuit board 64 in the upward direction 54. In other words, the prism 78 is positioned at a higher level than the circuit board 64. More specifically, the first inclined surface 78 A and the second inclined surface of the prism 78 are positioned at a higher level than the circuit board 64. The remaining amount detecting portion 75 has a size and shape appropriate for being positioned between the light emitting portion 122 and the light receiving portion 123 of the optical sensor 121.

As illustrated in FIG. 4B, the remaining amount detecting portion 75 includes a raised portion 76, a reflector 77, and a prism 78. The remaining amount detecting portion 75 is disposed in the second channel 46. That is, the prism 78 is positioned in the second channel 46. Also, the prism 78 is positioned in the ink channel 44, the prism 78 is positioned above the storage chamber 36, and the prism 78 is positioned above the inner upper wall 133.

The reflector 77 is made of, for example, aluminum foil, and is capable of reflecting light. The raised portion 76 protrudes upward relative to an upper surface (an inner lower surface of the second channel 46) of the inner upper wall 133. The reflector 77 includes a pair of inclined surfaces supported by an upper surface of the raised portion 76. The inclined surfaces of the reflector 77 extend in the upward direction 54 and are angled relative to the horizontal surface at, for example, 45°. The reflector 77 is disposed at an inner position than ends of the ink cartridge 30 in the leftward and rightward directions 56 and 55. The prism 78 is supported by an upper surface of the reflector 77. As illustrated in FIG. 4B, the prism 78 has a trapezoidal shape in a front view. The prism 78 is made of, for example, resin. The prism 78 includes a first inclined surface 78A, a second inclined surface 78B, a first horizontal surface 78C, and a second horizontal surface 78D.

The first inclined surface 78A and the second inclined surface 78B extend at an angle of 45°, for example, relative to horizontal. And the first inclined surface 78A is perpendicular to the second inclined surface 78B. That is, the first inclined surface 78A defines an angle of 90° relative to the second inclined surface 78B. The first horizontal surface 78C the second horizontal surface 78D are parallel each other and are parallel to horizontal. The first horizontal surface 78C and the second horizontal surface 78D are parallel to both a surface of the lower wall 127 and a surface of the inner upper wall 133. So, the first inclined surface 78A defines an angle of 45° relative to the first horizontal surface 78C, the second horizontal surface 78D, the surface of the lower wall 127, and the surface of the upper inner wall 133. Also, the second inclined surface 78B defines an angle of 45° relative to the first horizontal surface 78C, the second horizontal surface 78D, the surface of the lower wall 127, and the surface of the upper inner wall 133.

The first inclined surface 78A, the second inclined surface 78B, and the first horizontal surface 78C of the prism 78 face the second channel 46. Also, the first inclined surface 78A, the second inclined surface 78B, and the first horizontal surface 78C of the prism 78 define a part of the second channel 46. The first inclined surface 78A diagonally extends in the upward direction 54 from a right end of the prism 78 as the first inclined surface 78A extends in the leftward direction 56. The second inclined surface 78B diagonally extends in the upward direction 54 from a left end of the prism 78 as the second inclined surface 78B extends in the rightward direction 55. The first horizontal surface 78C connects between a left end of the first inclined surface 78A and a right end of the second inclined surface 78B. The second horizontal surface 78D connects between a right end of the first inclined surface 78A and a left end of the second inclined surface 78B and faces the reflector 77.

In the embodiment, the upper surface of the raised portion 76 is a portion of the upper surface of the storage chamber 36. Nevertheless, the upper surface of the raised portion 76 might not necessarily be a portion of the upper surface of the storage chamber 36.

In a case where the second channel 46 is full of ink and ink contacts the first inclined surface 78A and the second inclined surface 78B, light emitted in the leftward direction 56 from the light emitting portion 122 of the optical sensor 121 is reflected off the reflector 77 in the upward direction 54 as indicated by a dashed line in FIG. 4B, and enters the prism 78 through the second horizontal surface 78D. At that time, an incident angle of the light into the second horizontal surface 78D is approximately 90°. Therefore, the light travels straight to the second channel 46 through the first inclined surface 78A of the prism 78 without being refracted in the prism 78. That is, the light does not reach the light receiving portion 123 of the optical sensor 121. Therefore, the optical sensor 121 transmits a low level signal to the controller 1 (refer to FIG. 10).

In a case where ink stored in the second channel 46 has reduced and ink does not contact the first inclined surface 78A and the second inclined surface 78B, light emitted from the light emitting portion 122 of the optical sensor 121 is reflected off the reflector 77 in the upward direction 54 as indicated by a solid line in FIG. 4B and then is reflected off the first inclined surface 78A of the prism 78 in the leftward direction 56. Further, the light is reflected off the second inclined surface 78B of the prism 78 in the downward direction 53 and penetrates the prism 78 through the second horizontal surface 78D. The light is then reflected off the reflector 77 in the leftward direction 56 and reaches the light receiving portion 123 of the optical sensor 121. Upon arrival of the light on the light receiving portion 123, the signal transmitted from the optical sensor 121 to the controller 1 (refer to FIG. 10) changes from low level to high level.

[Controller 1]

Figure 10:
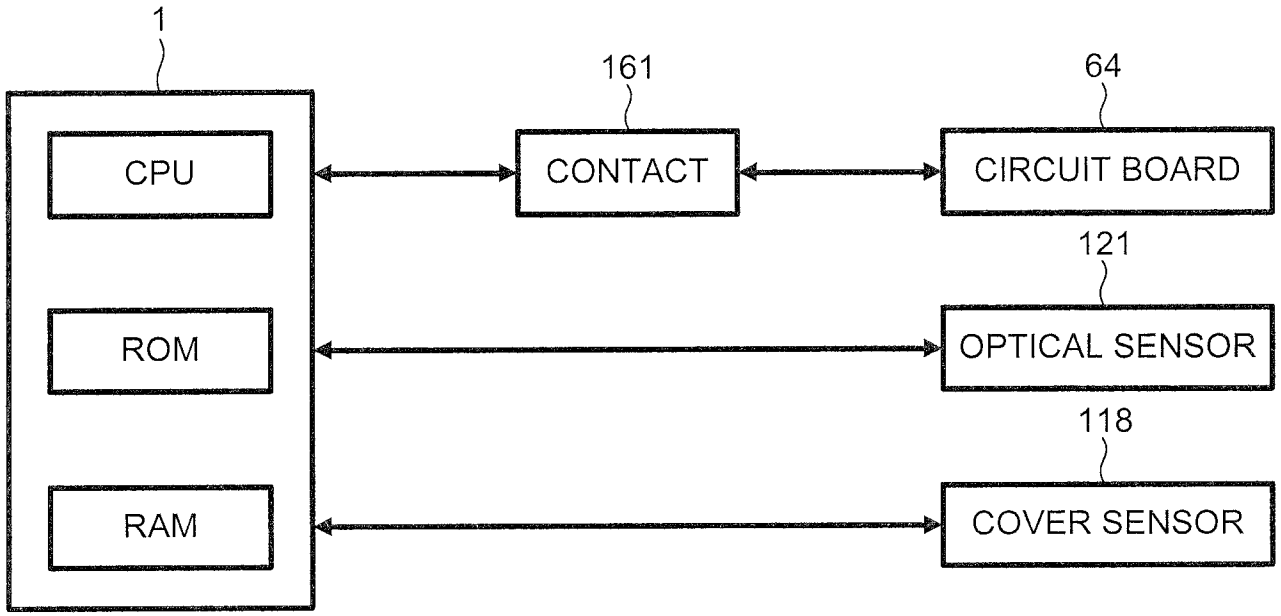
FIG. 10 is a block diagram illustrating a controller 1.

As illustrated in FIG. 10, the printer 10 includes the controller 1. The controller 1 includes, for example, a central processing unit ("CPU"), a read-only memory ("ROM"), and a random access memory ("RAM"). The controller 1 may be a control board that may be disposed inside a housing of the printer 10 as the controller 1 of the printer or may be a control board that may be independent from a controller of the printer 10 and that may be disposed at the casing 101. The controller 1 is connected to the contact 161 and the optical sensor 121 so as to be able to transmit and receive electric signals therebetween. As described above, in a state where the ink cartridge 30 is completely mounted on the cartridge mounting portion 110, establishment of electrical continuity between the contact 161 and the electrode of the circuit board 64 provides establishment of an electrical connection between the controller 1 and the circuit board 64. Although the controller 1 is also connected to other components, e.g., a motor and a touch panel, so as to be able to transmit and receive electric signals therebetween, the other components are omitted in FIG. 10. A program used for executing various processes by the controller 1 is stored in the ROM. The CPU executes computations for executing various processes based on the program stored in the ROM and provides instructions to each of the components. The RAM functions as a memory for storing various information temporarily.

The controller 1 detects insertion of the ink cartridge 30 into the cartridge mounting portion 110 through a level change of the signal transmitted from the optical sensor 121 from high level to low level. The controller 1 also detects a low ink remaining amount in the storage chamber 36 through the level change of the signal transmitted from the optical sensor 121 from low level to high level.

[Cartridge Installation Detection and Remaining Amount Detection]

Figure 11A:
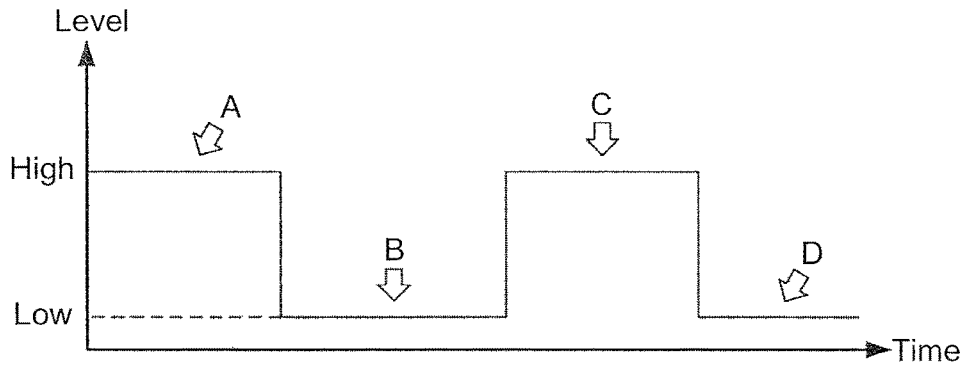
FIG. 11A illustrates changes in signal outputted from an optical sensor during insertion of the ink cartridge.

Hereinafter, cartridge installation detection and ink remaining amount detection by the optical sensor 121 will be described. As illustrated in FIG. 2, in a case where no ink cartridge 30 has been mounted to in the cartridge mounting portion 110, no obstruction that obstructs the path for light emitted from the light emitting portion 122 is present between the light emitting portion 122 and the light receiving portion 123 of the optical sensor 121. Therefore, as illustrated in FIG. 11A, a high level signal indicated by "A" is transmitted from the optical sensor 121 to the controller 1.

Figure 6:
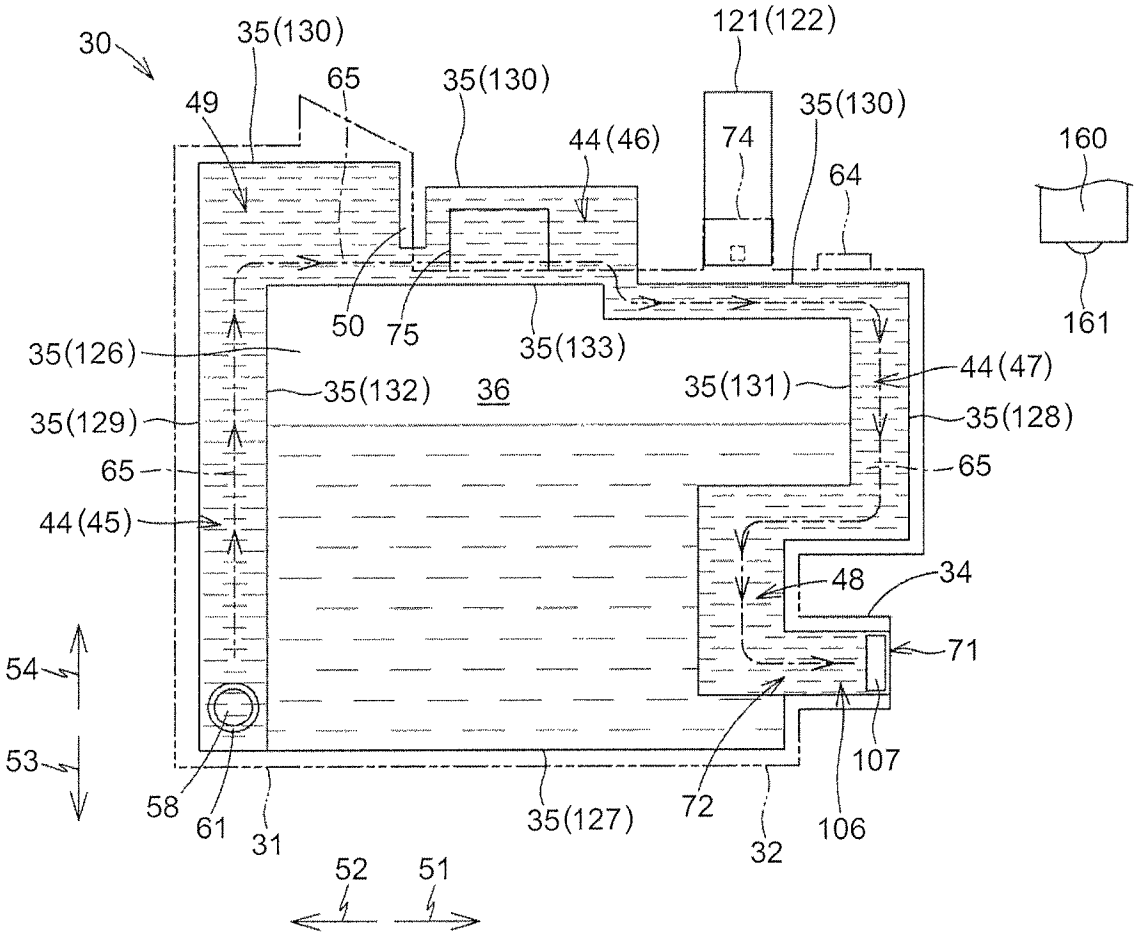
FIG. 6 is a schematic cross-sectional view of the ink cartridge, of which a raised portion is positioned between a light emitting portion and a light receiving portion.

As the ink cartridge 30 is inserted into the cartridge mounting portion 110 after the cover of the cartridge mounting portion 110 is opened, as illustrated in FIG. 6, during the insertion, the raised portion 74 reaches between the light emitting portion 122 and the light receiving portion 123 of the optical sensor 121 and the raised portion 74 obstructs the path for light emitted from the light emitting portion 122. Upon arrival of the raised portion 74 therebetween, the signal transmitted from the optical sensor 121 to the controller 1 changes from high level to low level indicated by "B" in FIG. 11A.

As the ink cartridge 30 is further moved in the frontward direction 51 from the state of FIG. 6, the raised portion 74 reaches a position further to the front than the optical sensor 121 in the frontward direction 51. Thus, the raised portion 74 does not obstruct the path for the light emitted from the light emitting portion 122. Upon termination of the obstruction, the signal transmitted from the optical sensor 121 to the controller 1 changes from low level to high level indicated by "C" in FIG. 11A. At that time, the optical sensor 121 is positioned between the raised portion 74 and the remaining amount detecting portion 75.

As the ink cartridge 30 is further moved in the frontward direction 51 from the position where the optical sensor 121 is positioned between the raised portion 74 and the remaining amount detecting portion 75, as illustrated in FIGS. 4A and 4B, the remaining amount detecting portion 75 reaches between the light emitting portion 122 and the light receiving portion 123 of the optical sensor 121. Since the second channel 46 is full of ink when the remaining amount detecting portion 75 reaches therebetween, the light emitted from the light emitting portion 122 does not reach the light receiving portion 123. Thus, a low level signal is transmitted from the optical sensor 121 to the controller 1. That is, upon arrival of the remaining amount detecting portion 75 on the position between the light emitting portion 122 and the light receiving portion 123, the signal transmitted from the optical sensor 121 to the controller 1 changes from high level to low level indicated by "D" in FIG. 11A.

In a state of FIGS. 4A and 4B, the circuit board 64 has reached below the contact 116 of the contact unit 160 and the electrode of the circuit board 64 contacts the contact 161. Contacting of a contact with a corresponding electrode establishes an electrical connection between the IC of the circuit board 64 and the controller 1. In the state of FIGS. 4A and 4B, the ink cartridge 30 is in a completely mounted position (in a use position) in which the ink cartridge 30 is completely mounted on the cartridge mounting portion 110. Finally, the cover of the cartridge mounting portion 110 is closed.

Figure 12:
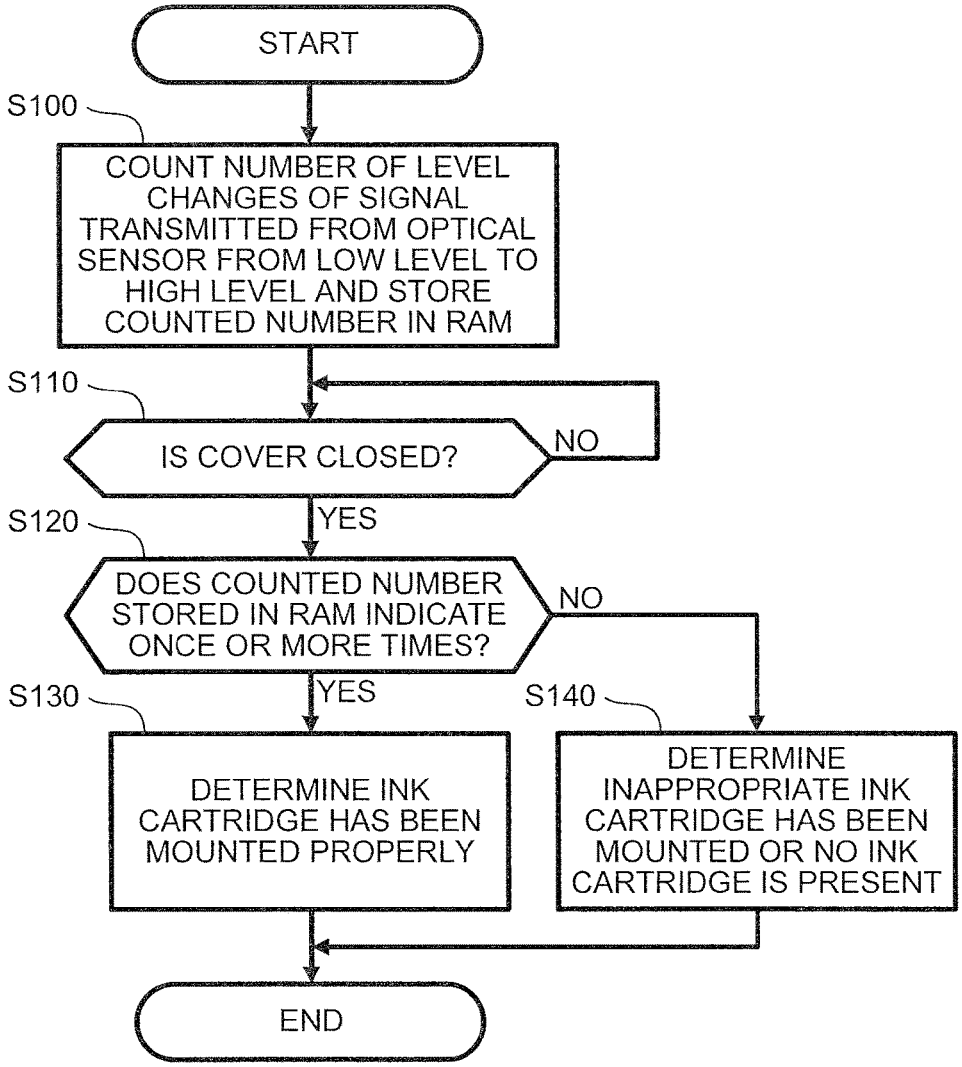
FIG. 12 is a flowchart for explaining detection of insertion of the ink cartridge into the cartridge mounting portion.

Hereinafter, referring to a flowchart of FIG. 12, detection of insertion of the ink cartridge 30 into its corresponding compartment space 103A of the cartridge mounting portion 110 will be described.

The controller 1 counts the number of times that the signal transmitted from the optical sensor 121 to the controller 1 has changed from low level to high level from a timing at which the cover of the cartridge mounting portion 110 is opened to a timing at which the cover is closed, and stores the counted number in the RAM (S100).

In response to closing of the cover (S110: Yes), the controller 1 refers to the counted number stored in the RAM (S120). In a case where the counted number indicates once or more times (S120: Yes), the controller 1 determines that the ink cartridge 30 has been mounted on the cartridge mounting portion 110 properly (step S130). In a case where the counted number indicates zero (S120: No), the controller 1 determines that an inappropriate ink cartridge has been mounted on the cartridge mounting portion 110 or that no ink cartridge 30 is present in the cartridge mounting portion 110 (step S140).

Figure 11B:
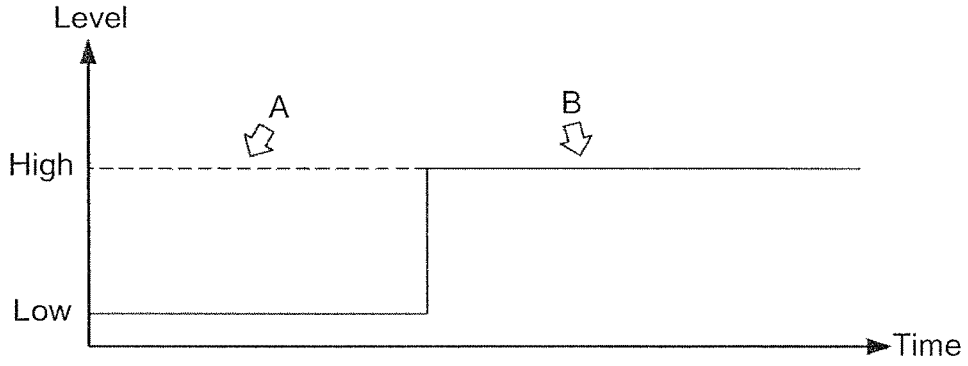
FIG. 11B illustrates changes in signal outputted from the optical sensor during decrease of ink stored in the ink cartridge.

Next, the ink remaining amount detection by the optical sensor 121 will be described. In a state where a remaining amount of ink stored in the storage chamber 36 is high, as illustrated in FIGS. 4A and 4B, the remaining amount detecting portion 75 obstructs the path for light between the light emitting portion 122 and the light receiving portion 123 of the optical sensor 121. Therefore, a low level signal indicated by "A" in FIG. 11B is transmitted from the optical sensor 121 to the controller 1 (refer to FIGS. 1 and 10).

In response to reduction of ink stored in the ink channel 44 due to use of ink stored in the ink cartridge 30 in the state of FIGS. 4A and 4B, the light emitted from the light emitting portion 122 of the optical sensor 121 reaches the light receiving portion 123 of the optical sensor 121 as indicated by a solid line in FIG. 4B. Upon arrival of the light on the light receiving portion 123, the signal transmitted from the optical sensor 121 to the controller 1 changes from low level to high level indicated by "B" in FIG. 11B. As a result of this, the controller 1 detects that the remaining mount of ink stored in the storage chamber 36 is low.

[First Variation]

In the embodiment, the remaining amount detecting portion 75 is raised upward from the upper surface of the inner upper wall 133 defining the lower surface of the second channel 46 of the ink channel 44. Nevertheless, the configuration of the remaining amount detecting portion 75 is not limited to such a configuration.

Figure 7B:
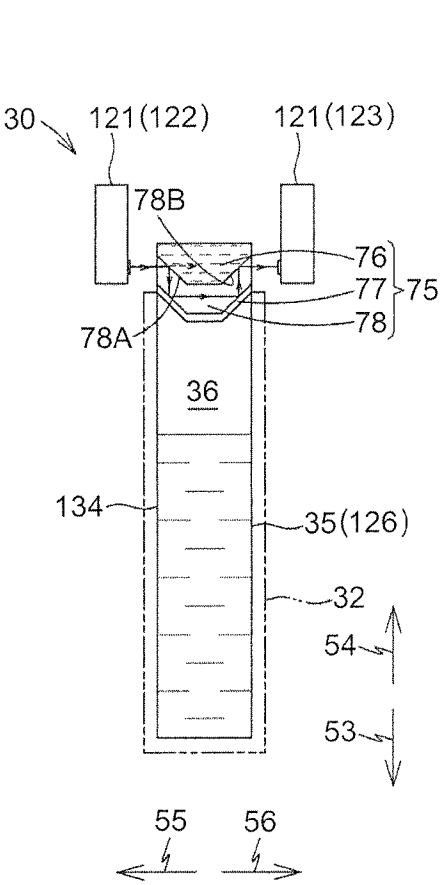
FIG. 7B is a schematic sectional view taken along line VII-VII of FIG. 7A.
Figure 7A:
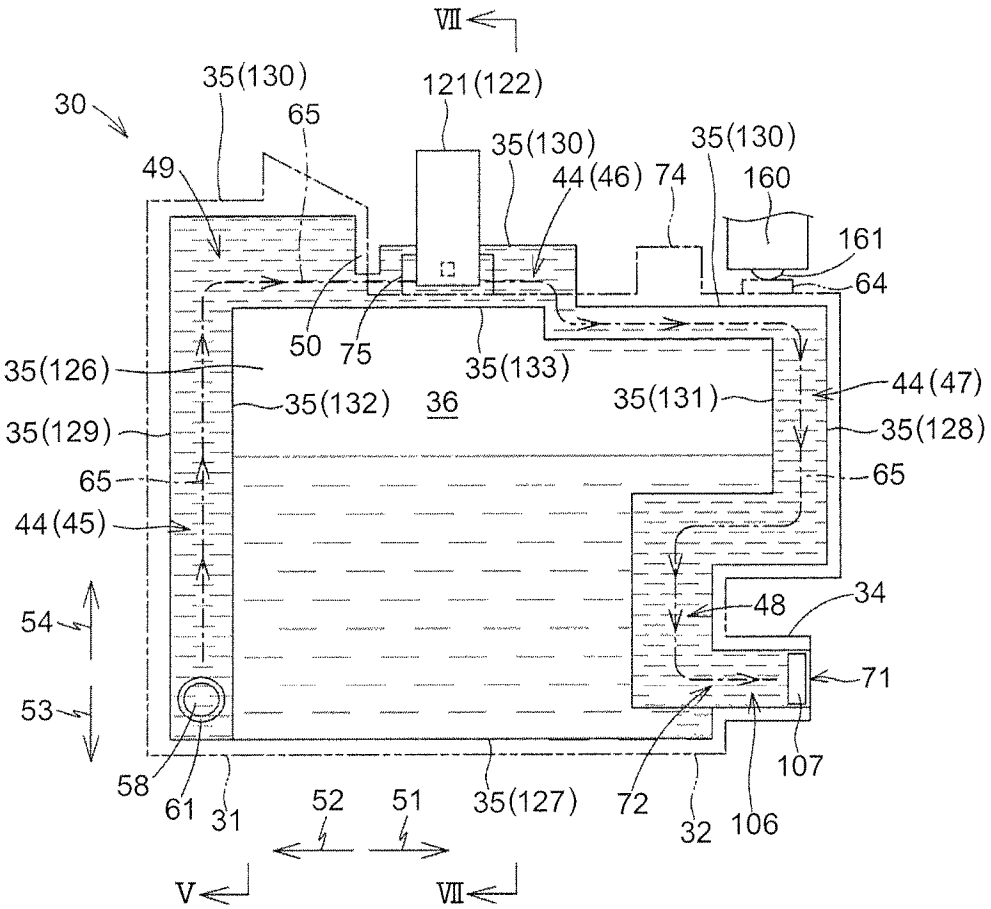
FIG. 7A is a schematic cross-sectional view of an ink cartridge in a first variation.

In one example, as illustrated in FIGS. 7A and 7B, the remaining amount detecting portion 75 may protrude downward relative to a lower surface of the outer upper wall 130 defining the upper surface of the second channel 46 of the ink channel 44. In another example, the remaining amount detecting portion 75 may protrude in the rightward direction 55 relative to the left wall 126 defining the left surface of the second channel 46 of the ink channel 44.

In the configuration illustrated in FIGS. 7A and 7B, in a case where the second channel 46 is full of ink and ink contacts both the first inclined surface 78A and the second inclined surface 78B, light emitted in the leftward direction 56 from the light emitting portion 122 of the optical sensor 121 penetrates the first inclined surface 78A of the prism 78 as indicated by a dashed line in FIG. 7B. Nevertheless, light does not penetrate ink and thus does not reach the second inclined surface 78B. Therefore, a low level signal is transmitted from the optical sensor 121 to the controller 1.

In a case where ink stored in the second channel 46 has reduced and ink does not contact the first inclined surface 78A and the second inclined surface 78B, as indicated by a solid line in FIG. 7B, light emitted from the light emitting portion 122 of the optical sensor 121 is reflected off the first inclined surface 78A in the downward direction 53, and is then reflected off the reflector 77 in the leftward direction 56 and is further reflected off the reflector 77 in the upward direction 54. Thereafter, the reflected light is further reflected off the second inclined surface 78B in the leftward direction 56 and reaches the light receiving portion 123 of the optical sensor 121. Upon arrival of the signal on the light receiving portion 123, the signal transmitted from the optical sensor 121 to the controller 1 changes from low level to high level. As a result, the controller 1 detects that the remaining mount of ink stored in the storage chamber 36 is low.

[Second Variation]

The configurations of the ink channel 44 and the differential pressure regulating valve 57 are not limited to the configurations of the embodiment. For example, the ink channel 44 and the differential pressure regulating valve 57 may have configurations illustrated in FIGS. 8A and 8B.

Figure 8B:
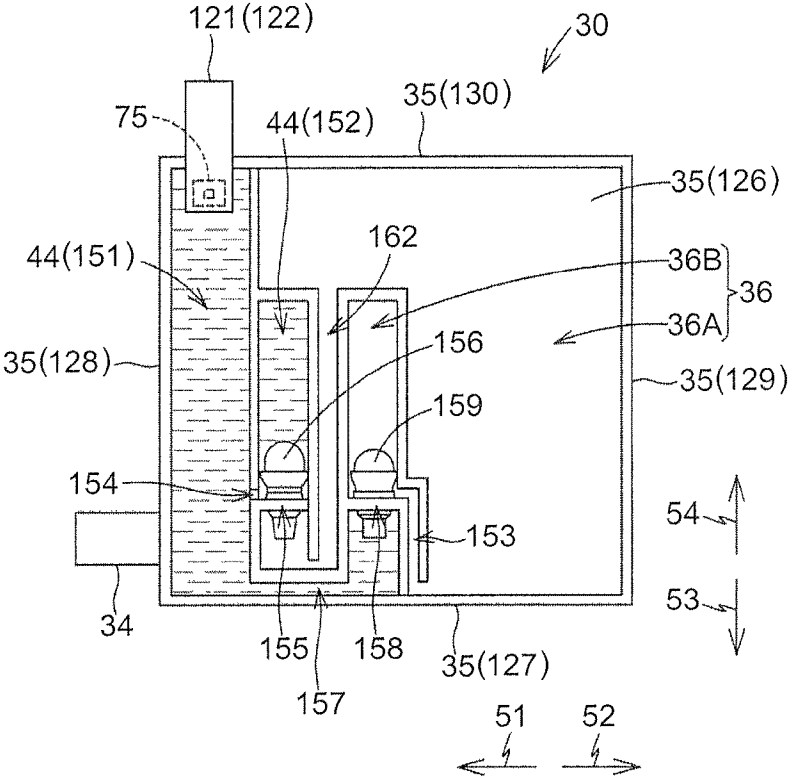
FIG. 8B is a schematic cross-sectional view of the ink cartridge in the second variation, wherein the opening is closed.
Figure 8A:
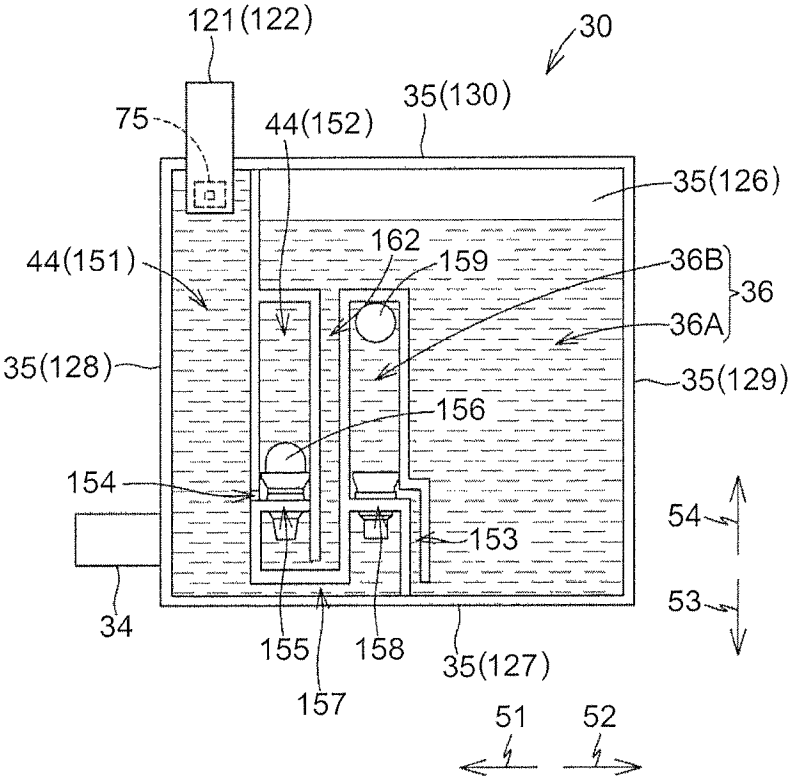
FIG. 8A is a schematic cross-sectional view of an ink cartridge in a second variation, wherein an opening is opened.

In a second variation, as illustrated in FIGS. 8A and 8B, the ink channel 44 is defined in a front portion of the ink cartridge 30 and the storage chamber 36 is defined in a rear portion of the ink cartridge 30.

The ink channel 44 includes a first channel 151 and a second channel 152. The first channel 151 is in communication with the ink supply portion 34. The second channel 152 is defined to the rear of the first channel 151 in the rearward direction 52. The second channel 152 is in communication with the first channel 151 via an opening 154 (as an example of a first communication opening) and is in communication with one storage chamber 36A of the storage chamber 36 via an opening 155 (as an example of a second communication opening) and a passage 162. A sphere 156 (as an example of a second sphere) is proximate the opening 155. The opening 155 is configured to be opened and closed by a sphere 156 that is movable along the upward direction 54 and the downward direction 53.

The storage chamber 36 includes the one storage chamber 36A and the other storage chamber 36B. The other storage chamber 36B is defined to the rear of the second channel 152 in the rearward direction 52. The other storage chamber 36B is in communication with the first channel 151 via an opening 158 (as an example of a first communication opening) and a passage 157 and is in communication with the one storage chamber 36A via a passage 153. A sphere 159 (as an example of a first sphere) is proximate the opening 158. The opening 158 is configured to be opened and closed by the sphere 159 that is movable along the upward direction 54 and the downward direction 53. In the second variation, the storage chamber 36 is in communication with an air communication portion (not illustrated), and air is supplied into the storage chamber 36 as ink is used.

The differential pressure regulating valve 57 includes the spheres 156 and 159. The sphere 156 is disposed in the second channel 152. The sphere 156 has a higher specific gravity than ink. Therefore, in a state where the second channel 152 is full of ink, the sphere 156 is positioned at a lower position in the downward direction 53 to close the opening 155. The sphere 159 is disposed in the other storage chamber 36B. The sphere 159 has a lower specific gravity than ink. Therefore, in a state where the second channel 152 is full of ink, the sphere 159 is positioned at an upper position in the upward direction 54 by its buoyancy based on ink to open the opening 158.

The remaining amount detecting portion 75 is disposed at an upper end portion of the first channel 151. The configuration of the remaining amount detecting portion 75 is similar to that of the embodiment, and therefore, an explanation for the remaining amount detecting portion 75 will be omitted.

Hereinafter, behavior of the differential pressure regulating valve 57 according to the second variation will be described. As illustrated in FIG. 8A, in a state the storage chamber 36 and the ink channel 44 are both full of ink, the sphere 156 is positioned at the lower position and closes the opening 155 and the sphere 159 is positioned at the upper position and opens the opening 158. Therefore, when ink is supplied from the ink cartridge 30 to the ink tube 20, ink stored in the one storage chamber 36A is supplied to the ink tube 20 via the other storage chamber 36B, the first channel 151, and the ink supply portion 34.

As illustrated in FIG. 8B, in a state where the storage chamber 36 is empty of ink, there is no buoyancy based on ink, and therefore, the sphere 159 is located at the lower position in the downward direction 53 and closes the opening 158. Thus, communication between the ink channel 44 and the storage chamber 36 is not established. Therefore at the time of supplying ink from the ink cartridge 30 to the ink tube 20, ink stored in the ink channel 44 is supplied to the ink tube 20 via the ink supply portion 34.

Figure 9B:
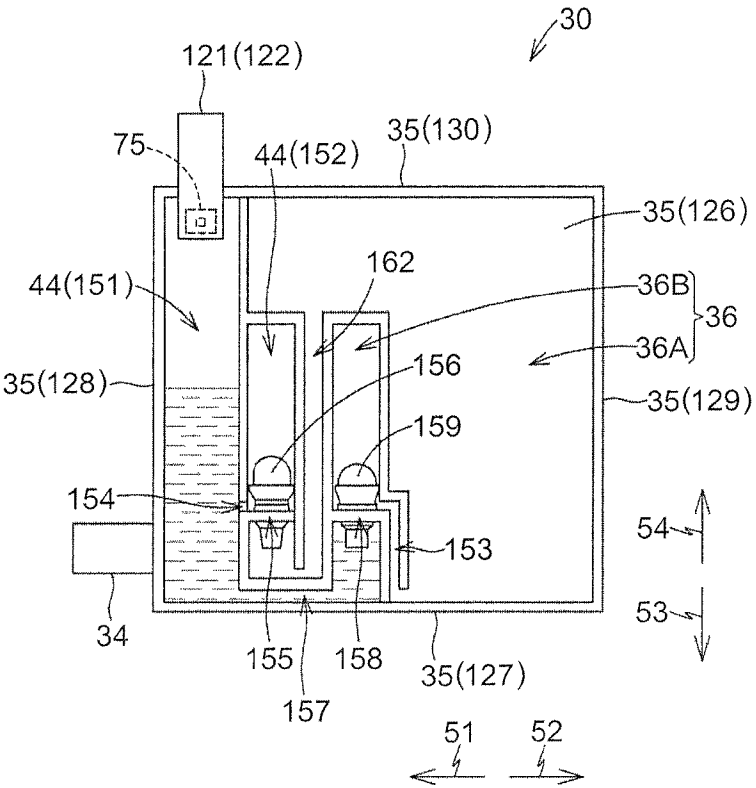
FIG. 9B is a schematic cross-sectional view of the ink cartridge in the second variation, wherein an opening is opened.
Figure 9A:
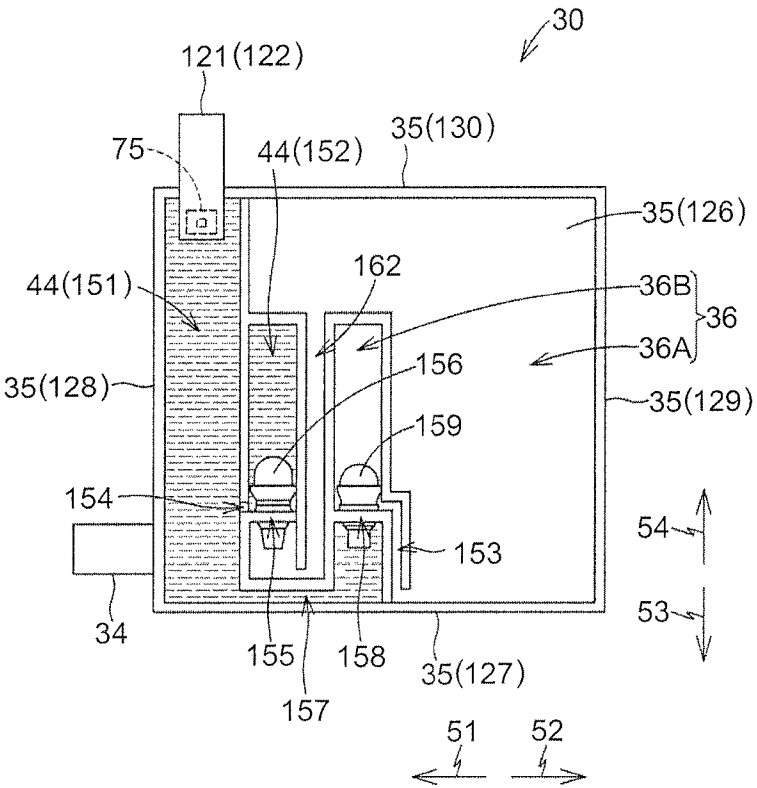
FIG. 9A is a schematic cross-sectional view of the ink cartridge in the second variation, wherein an ink channel is under negative pressure.

As ink stored in the ink channel 44 reduces, negative pressure occurs in the ink channel 44 (refer to FIG. 9A). In FIG. 9A, the occurrence of negative pressure is indicated by increase of density of dashed lines in the ink channel 44.

When the negative pressure becomes lower than the pressure in the storage chamber 36 by a predetermined amount or more, as illustrated in FIG. 9B, the sphere 156 starts moving upward by the negative pressure. That is, when the pressure in the ink channel 44 becomes lower than the pressure in the storage chamber 36 by the predetermined amount or more, the sphere 156 opens the opening 155. The predetermined amount is specified appropriately such that ink stored in the ink channel 44 surely and effectively flows therefrom, by adjusting material and size of the sphere 156 and a size of the opening 155.

As the opening 155 is opened, communication between the one storage chamber 36A and the second channel 152 becomes established. Thus, the pressure in the ink channel 44 returns to atmospheric pressure (the pressure in the storage chamber 36) from the negative pressure. In response to this, the sphere 156 closes the opening 155 again.

Subsequent to this, while the opening and closing of the opening 155 is repeated, ink stored in the ink channel 44 is consumed.

The configuration of the differential pressure regulating valve 57 is not limited to the configuration in which the body 58 and the coil spring 62 of the differential pressure regulating valve 57 are disposed inside the storage chamber 36 for closing the opening 66. For example, the body 58 and the coil spring 62 of the differential pressure regulating valve 57 may be disposed inside the ink channel 44 for closing the opening 66. The differential pressure regulating valve 57 is not limited to the configuration in which the body 58 and the coil spring 62 are used. For example, the differential pressure regulating valve 57 may have a configuration in which a flexible film, which is deformable in accordance with pressure difference caused between the storage chamber 36 and the ink channel 44, is used for closing the opening 66.

[Other Variations]

In the embodiment, the remaining amount detecting portion 75 is disposed at a higher level than the ink supply portion 34 in the upward direction 54 and further to the rear than the ink supply portion 34 in the rearward direction 52. Nevertheless, the remaining amount detecting portion might not necessarily be disposed at a higher level than the ink supply portion 34 in the upward direction 54 and further to the rear than the ink supply portion 34 in the rearward direction 52. For example, the remaining amount detecting portion 75 may be disposed at a lower level than the ink supply portion 34 in the downward direction 53.

In the embodiment, ink stored in the storage chamber 36 is allowed to flow to the outside of the ink cartridge 30 via the ink channel 44. Nevertheless, for example, ink may be allowed to flow to the outside of the ink cartridge 30 via a second storage chamber provided separately from the storage chamber 36. In contrast to the ink channel 44, the second storage chamber might not be elongated along an ink flow direction.

In the embodiment, the remaining amount detecting portion 75 includes the reflector 77. Nevertheless, the remaining amount detecting portion 75 might not necessarily include the reflector 77. In a case that the remaining amount detecting portion 75 does not include the reflector 77, the prism 78 has a different shape from the prism 78 of the embodiment. More specifically, the prism 78 includes inclined surfaces at its lower surface similar to the reflector 77 of the embodiment.

Figure 13:
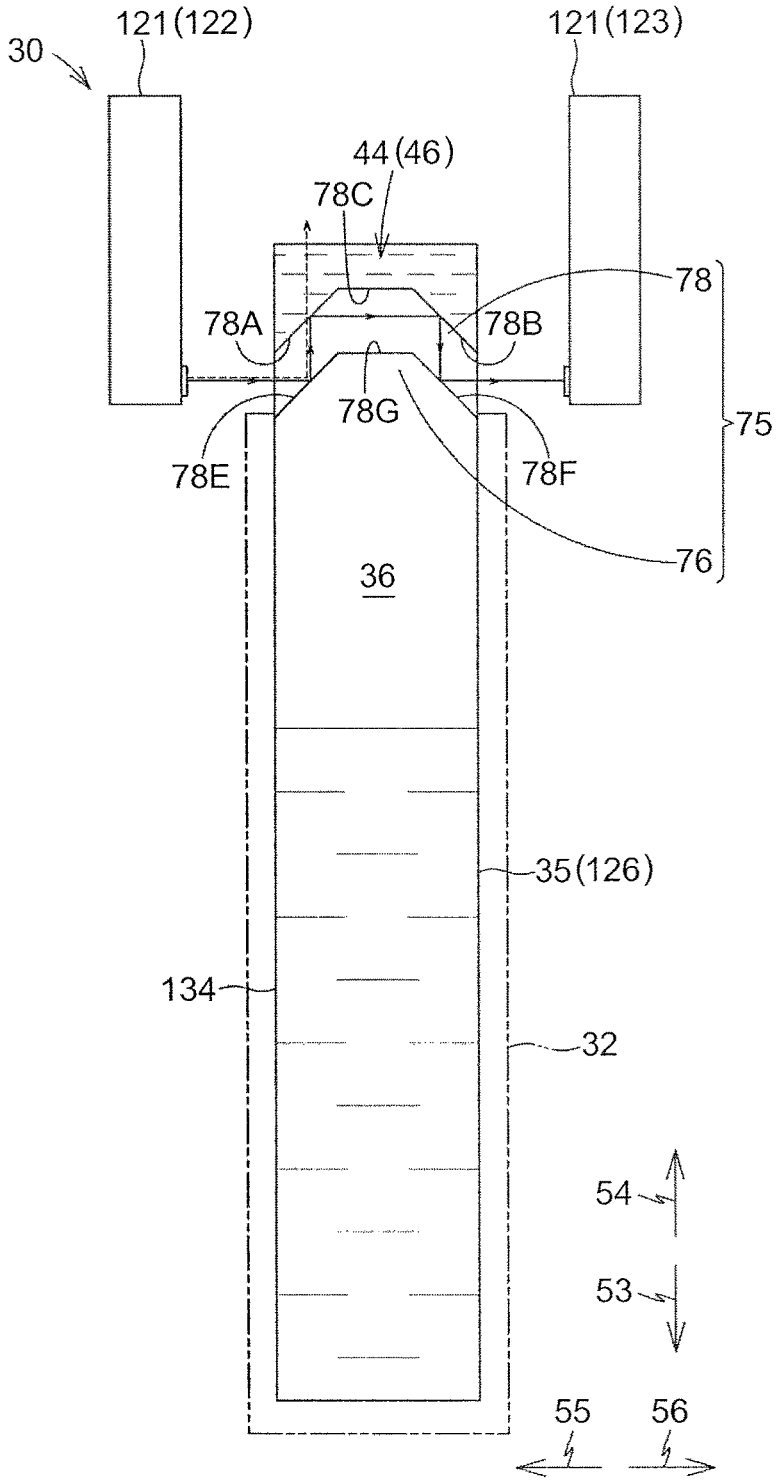
FIG. 13 is a sectional diagram taken along line IV-IV of FIG. 4A in another variation.

More specifically, as illustrated in FIG. 13, the prism 78 includes a first lower inclined surface 78E, a second lower inclined surface 78F, and a third horizontal surface 78G at its lower surface. The first lower inclined surface 78E diagonally extends in the upward direction 54 from the right end of the prism 78 as the first lower inclined surface 78E extends in the leftward direction 56. The second lower inclined surface 78F diagonally extends in the upward direction 54 from the left end of the prism 78 as the second lower inclined surface 78F extends in the rightward direction 55. The third horizontal surface 78G connects between a left end of the first lower inclined surface 78E and a right end of the second lower inclined surface 78F. The first lower inclined surface 78E, the second lower inclined surface 78F, and the third horizontal surface 78G face the storage chamber 36.

In a state where ink stored in the ink cartridge 30 has reduced to a particular level that the remaining amount of ink stored in the ink channel 44 is detected, an upper end portion (a position where the storage chamber 36 contacts the prism 78) of the storage chamber 36 is filled with air but not ink. Therefore, light emitted in the leftward direction 56 from the light emitting portion 122 is reflected off the first lower inclined surface 78E and the second lower inclined surface 78F of the prism 78. That is, the light emitted from the light emitting portion 122 travels in a similar route to the light that travels in the configuration in which the remaining amount detecting portion 75 includes the reflector 77.

In the embodiment, the ink cartridge 30 is mounted to the cartridge mounting portion 110 while being moved along the horizontal direction. Nevertheless, the moving direction of the ink cartridge 30 at the time of mounting the ink cartridge 30 to the cartridge mounting portion 110 is not limited to the horizontal direction. For example, an ink cartridge may be inserted into a cartridge mounting portion along the vertical direction. At that time, the locations and configurations of, for example, the ink channel 44, the differential pressure regulating valve 57, and the remaining amount detecting portion 75, may be appropriately changed in accordance with the insertion direction of the ink cartridge.

In the embodiment, the description has been made by taking ink as an example of liquid. Nevertheless, the disclosure is not limited to the specific example. For example, instead of ink, pretreatment liquid ejected prior to ink at the time of printing may be another example of liquid.

Example Effects

According to some embodiments, the first inclined surface 78A is disposed at a higher level than the ink supply port 71 in the upward direction 51 and further to the rear than the ink supply port 71 in the rearward direction 52. Therefore, this configuration may reduce a risk of splashes of ink adhering the ink supply port 71 onto the remaining amount detecting portion 75 or the prism 78. Accordingly, in a case where the remaining amount of ink stored in the ink cartridge 30 is detected by light emission from the light emitting portion 122 toward the first inclined surface 78A, this configuration may reduce a risk that whether the ink remaining amount is low or not is detected incorrectly.

According to the embodiment, the remaining amount detecting portion 75 or the prism 78 is disposed at a higher level than the inner upper wall 133 in the upward direction 51. Therefore, this configuration may further reduce the risk of splashes of ink adhering the ink supply port 71 onto the remaining amount detecting portion 75.

Generally, the remaining amount detecting portion 75 or the prism 78 is disposed, in the ink cartridge 30, at a position where it can be detected that the ink remaining amount of the ink cartridge 30 has become a predetermined amount. In the embodiment, the remaining amount detecting portion 75 is disposed at the ink channel 44. The amount of ink stored in the ink channel 44 may be obtained more precisely as compared with the amount of ink stored in the storage chamber 36. Therefore, according to the embodiment, the predetermined amount may be established precisely.

According to the embodiment, the first buffer chamber 48 is configured to store ink therein. Therefore, a larger amount may be established for the predetermined amount.

If air is present in the remaining amount detecting portion 75 where ink is present, the ink remaining amount may be detected incorrectly when light is emitted to the remaining amount detecting portion 75. According to the embodiment, the differential pressure regulating valve 57 may shut communication between the storage chamber 36 and the ink channel 44. Therefore, this configuration may avoid intrusion of air included in the storage chamber 36 into the ink channel 44, which may result in avoiding the incorrect detection.

According to the embodiment, even if air intrudes into the ink channel 44 from the storage chamber 36, the second buffer chamber 49 may trap the intruded air therein. Therefore, this configuration may reduce a risk that air intrudes into the remaining amount detecting portion 75. As a result, this configuration may reduce the risk of incorrect detection that may be caused when light is emitted toward the remaining amount detecting portion 75.

According to the embodiment, the cross-sectional area of the second channel 46 in the vicinity of the remaining amount detecting portion 75 is smaller than the cross-sectional area of the ink channel 44 at the portions other than the vicinity portion. Therefore, even if air intrudes into the ink channel 44 from the storage chamber 36, this configuration may reduce a risk that the air moves to the remaining amount detecting portion 75.

According to the embodiment, the remaining amount detecting portion 75 is disposed at the lower portion of the second channel 46. Even if air is present in the second channel 46, the air may be positioned at the upper portion of the second channel 46 in many cases. Therefore, this configuration may reduce the risk of incorrect detection that may be caused when light is emitted toward the remaining amount detecting portion 75.

According to the embodiment, the reflector 77 reflects light in the upward direction 54. With this configuration, the prism 78 may be disposed at the position where the prism 78 is positioned at a far higher level from the ink supply port 71, irrespective of the location of the light emitting portion of the optical sensor 121.

Normally, while the ink cartridge 30 is being inserted into or removed from the cartridge mounting portion 110, the electrode of the circuit board 64 contacts the contact 161 of the cartridge mounting portion 110. However, the contact therebetween while the ink cartridge 30 is being inserted into or removed from the cartridge mounting portion 110 may produce shavings of the electrode. According to the embodiment, the remaining amount detecting portion 75 is disposed at a higher level than the circuit board 64 in the upward direction 54. Therefore, this configuration may reduce a risk of adhesion of the shavings to the remaining amount detecting portion 75.

What is claimed is:

1. A liquid cartridge configured to be received by a cartridge mounting portion of a printer in an insertion direction, the liquid cartridge comprising:

a first wall, a second wall spaced apart from the first wall;

a liquid supply portion including an opening through the first wall and a supply port configured to provide communication from an interior to an exterior of the liquid cartridge, the liquid supply portion defining a horizontal flow path in the insertion direction;

a first storage chamber situated between the first and second walls and having a first communication opening;

a second storage chamber at least partially above the first storage chamber and in fluid communication with the first storage chamber via the first communication opening; and the second storage chamber including a prism, the prism including a first inclined surface configured to change the state of received light in response to a level of liquid contained in the second storage chamber.

2. The liquid cartridge of claim 1, wherein:

the prism is positioned above the first storage chamber; and the second storage chamber is partially positioned above the first storage chamber.

3. The liquid cartridge of claim 1, wherein an upper end of the second storage chamber is positioned higher than an upper end of the first storage chamber.

4. The liquid cartridge of claim 1, further comprising a third wall positioned between the first wall and the second wall, wherein the first storage chamber is positioned below the third wall and the second storage chamber is partially positioned above the third wall.

5. The liquid cartridge of claim 4, wherein the prism is positioned above the third wall.

6. The liquid cartridge of claim 4, wherein the liquid supply port is positioned below the third wall.

7. The liquid cartridge of claim 4, wherein the first inclined surface of the prism intersects a surface of the third wall.

8. The liquid cartridge of claim 7, wherein an angle between the first inclined surface of the prism and the surface of the third wall is 45°.

9. The liquid cartridge of claim 4, further comprising a bottom wall positioned below both the first and second storage chambers and positioned between the first wall and the second wall.

10. The liquid cartridge of claim 9, wherein an angle between a first plane defined by the first inclined surface of the prism and a second plane defined by the surface of the bottom wall is 45°.

11. The liquid cartridge of claim 1, wherein the first inclined surface defines a part of the second storage chamber.

12. The liquid cartridge of claim 1, wherein the first inclined surface defines an angle of 45° relative to a horizontal surface.

13. The liquid cartridge of claim 1, wherein:

the second storage chamber is a liquid channel that connects between the first storage chamber and the liquid supply port, and the second storage chamber has a longer length along a flow direction that liquid flows than a perimeter of a cross-section of the second storage chamber cut in a direction orthogonal to the flow direction.

14. The liquid cartridge of claim 13, wherein the second storage chamber includes:

a first channel located between the first storage chamber and the second wall;

a second channel located above the first storage chamber and contiguous to the first channel; and a third channel located between the first storage chamber and the first wall, and is contiguous to the second channel, and wherein the third channel is in communication with the liquid supply port.

15. The liquid cartridge of claim 14, wherein the prism is positioned in the second channel.

16. The liquid cartridge of claim 14, wherein:

the third channel defines a first buffer chamber between the prism and the liquid supply port, and the first buffer chamber extends farther towards the first channel than a remaining portion of the third channel.

17. The liquid cartridge of claim 16, wherein the first buffer chamber is positioned below the prism.

18. The liquid cartridge of claim 14, wherein:

the second channel defines a second buffer chamber between the prism ant the first communication opening, and the second buffer chamber extends higher than a remaining portion of the second channel.

19. The liquid cartridge of claim 18, wherein:

the second channel defines a remaining amount detection portion having the prism therein;

the second channel defines a communication port between the second buffer and the remaining amount detection portion;

a cross-sectional area of the communication port of the second channel is smaller than a cross-sectional area of the second buffer chamber; and the cross-sectional area of the communication port of the second channel is smaller than a cross-sectional area of the remaining amount detecting portion.

20. The liquid cartridge of claim 19, further comprising a raised portion protruding upwards into the remaining amount detection portion from an inner lower surface of the second channel.

21. The liquid cartridge of claim 20, wherein the raised portion includes a surface positioned to face the first inclined surface of the prism.

22. The liquid cartridge of claim 21, wherein the raised portion includes a reflector positioned to face the first inclined surface.

23. The liquid cartridge of claim 22, wherein the reflector is positioned below the first inclined surface of the prism.

24. The liquid cartridge of claim 1, further comprising a differential pressure regulating valve configured to open and close the first communication opening in accordance with pressure difference caused between the first storage chamber and the second storage chamber.

25. The liquid cartridge of claim 24, wherein:

the first storage chamber has a second communication opening, the second storage chamber extends between the second communication opening and the liquid supply port, the pressure regulating valve includes:

a first sphere proximate the first communication opening and configured to open the first communication opening by moving due to buoyancy based on liquid stored in the first storage chamber; and a second sphere proximate the second communication opening and configured to open the second communication opening in accordance with the pressure in the second storage chamber becoming less than the pressure in the first storage chamber.

26. The liquid of claim 25, wherein the second sphere is configured to open the second communication opening in accordance with the pressure in the second storage chamber becoming less than the pressure in the first storage chamber by at least a predetermined amount.

27. The liquid cartridge of claim 24, further comprising a film defining a portion of the first storage chamber, wherein the differential pressure regulating valve is configured to open the first communication opening by moving in accordance with deformation of the film.

28. The liquid cartridge of claim 1, further comprising a reflector facing the first inclined surface of the prism.

29. The liquid cartridge of claim 1, wherein:

the prism further includes a second inclined surface configured to change the state of received light in response to a level of liquid contained in the second storage chamber; and the second inclined surface is perpendicular to the first inclined surface.

30. The liquid cartridge of claim 1, further comprising an circuit board including an electrode, wherein the first inclined surface of the prism is positioned at a higher level than the circuit board.

* * * * *